US006947862B2

(12) United States Patent
Eaton et al.

(10) Patent No.: US 6,947,862 B2
(45) Date of Patent: Sep. 20, 2005

(54) METHOD FOR SIMULATING SLURRY FLOW FOR A GROOVED POLISHING PAD

(75) Inventors: John K. Eaton, Stanford, CA (US); Christopher J. Elkins, Redwood City, CA (US); Tristan M. Burton, San Francisco, CA (US)

(73) Assignee: Nikon Corporation (JP)

( * ) Notice: Subject to any disclaimer, the term of this patent is extended or adjusted under 35 U.S.C. 154(b) by 61 days.

(21) Appl. No.: 10/367,039

(22) Filed: Feb. 14, 2003

(65) Prior Publication Data

US 2004/0162688 A1 Aug. 19, 2004

(51) Int. Cl.[7] ..... G01F 1/12

(52) U.S. Cl. ..... 702/100; 702/22; 702/45; 702/50

(58) Field of Search ..... 73/861.47, 861.48; 702/22, 30, 45, 50, 100; 451/36, 41–42, 272; 360/234.1, 235.1; 438/745, 747

(56) References Cited

U.S. PATENT DOCUMENTS

| | | | | |
|---|---|---|---|---|
| 5,562,530 A | * | 10/1996 | Runnels et al. | 451/36 |
| 5,780,748 A | | 7/1998 | Barth | |
| 5,783,497 A | * | 7/1998 | Runnels et al. | 438/747 |
| 6,120,366 A | | 9/2000 | Lin et al. | |

FOREIGN PATENT DOCUMENTS

| | | |
|---|---|---|
| JP | 7-307334 A | 11/1995 |
| JP | 11-126765 A | 5/1999 |
| WO | WO 98/14306 | 4/1998 |

OTHER PUBLICATIONS

Scott R. Runnels and L. Michael Eyman. "Tribology Analysis of Chemical–Mechanical Polishing" J. Electrochem. Soc., vol. 141. No. 6, Jun. 1994 Copyright The Electrochemical Society, Inc. pp. 1698–1701.

Scott R. Runnels "Advances in Physically Based Erosion Simulators for CMP," Journal of Electronic Materials, vol. 25, No. 10. 1996. Special Issue Paper. pp. 1574–1580.

Dan Towery and Michael A. Fury. "Chemical Mechanical Polishing of Organic Polymeric Materials for IC Applications." Chapter 6. Handbook of Low and High Dielectric Constant Materials and Their Applications, edited by H.S. Nalwa, vol. 1 Materials and Processing. Copyright 1999 by Academic Press.

Andrew T. Kim, Jongwon Seok, John A. Tichy, and Timothy S. Cale, "A Multiscale Contact Mechanics and Hydrodynamics Model of Chemical Mechanical Polishing." Sep. 25–26, 2001 VMIC Conference. 6 Pages.

John Tichy, Joseph A. Levert, Ler Shan, and Steven Danyluk. "Contact Mechanics and Lubrication Hydrodynamics of Chemical Mechanical Polishing." Journal of The Electrochemical Society 146 (4) 1523–1258 (1999).

Bernard J. Hamrock. *Fundamentals of Fluid Film Lubrication*. Copyright 1994 by McGraw–Hill, Inc. pp. 128–130 and Chapter 7, pp. 141–160.

(Continued)

*Primary Examiner*—Bryan Bui
(74) *Attorney, Agent, or Firm*—Steven G. Roeder; Jim Rose

(57) ABSTRACT

A method for determining the flow of a fluid (60) in a gap (64) between a pad (48) and a substrate (12) includes the step of utilizing a hybrid Navier-Stokes/lubrication formulation to calculate the flow of the fluid (60) in the gap (64) at a plurality of time steps. The gap (64) can be divided into a plurality of elements (700). The hybrid Navier-Stokes/lubrication formulation can be used to calculate the fluid flow and the pressure of the fluid (60) at each element (700) at the plurality of time steps. Additionally, a method for tracking and estimating the composition of the fluid (60) at various locations in the gap (64) and a material removal rate model that attempts to account for the effects of the fluid flow in the gap (64), the hydrostatic pressure in the gap (64) and the composition of the fluid (60) in the gap (64) are provided herein.

64 Claims, 10 Drawing Sheets

OTHER PUBLICATIONS

Jianfeng Luo and David A. Dornfeld. "Material Removal Mechanism in Chemical Mechanical Polishing: Theory and Modeling." (2002) *IEEE Transactions on Semiconductor Manufacturing*. pp. 112–133.

Z. Stavreva, D. Zeidler, M. Plotner, K. Drescher. "Influence of Process Parameters on Chemical–Mechanical Polishing of Copper." (1997) Microelectric Engineering 37/38, pp. 143–149.

Yongwu Zhao, L. Chang. "A Micro–Contact and Wear Model for Chemical–Mechanical Polishing of Silicon Wafers." (2002) Wear 252, pp. 220–226.

F. Preston. "The Theory and Design of Plate Glass Polishing Machines." (1927) *Journal of the Society of Glass Technology*. pp. 214–256.

* cited by examiner

METHOD FOR SIMULATING SLURRY FLOW FOR A GROOVED POLISHING PAD

FIELD OF THE INVENTION

The present invention relates to a method for simulating fluid flow between a grooved polishing pad and a wafer that is being polished by the pad. The present invention also relates to an apparatus that utilizes and/or calculates fluid flow.

BACKGROUND

Chemical mechanical polishing apparatuses (CMP apparatuses) are commonly used for the planarization of silicon wafers. In one type of CMP apparatus, a rotating pad is placed in contact with a rotating wafer and the pad is moved back and forth laterally relative to the rotating wafer. Additionally, a polishing slurry is forced into a gap between the wafer and the pad. The slurry is typically an aqueous solution that carries a high concentration of nanoscale abrasive particles. The slurry can play a number of critical roles in the polishing of the wafer. For example, the chemical composition of the slurry can alter the surface properties of the wafer, soften the wafer surface and make it amenable to material removal. Further, the abrasive particles in the slurry remove material from the wafer surface by cutting nanoscale grooves in the wafer surface.

Some in the industry believe that most of the material removal occurs when pad asperities on the pad are in contact with the wafer, trapping slurry particles between them. The asperities push the particles into the wafer surface and drag them along so the abrasive particles act as nanoscale cutting tools. Slurry particles dragged along the wafer by fluid friction probably contribute, at most, a small fraction of the overall material removal.

Designers are constantly trying to improve the accuracy and efficiency of CMP apparatuses. For example, if the material removal rate of the pad can be accurately calculated for a range of configurations, the movement of the pad, the rotation rate of the pad, the pressure applied by the pad, the rotation rate of the wafer, the design of the pad, the location of the inlets for the slurry and/or the rate of slurry flow can be adjusted and controlled to improve accuracy and efficiency.

Unfortunately, a number of factors are believed to influence the material removal rate of the CMP apparatus. Some of these factors can not be quickly and accurately calculated. Other factors are currently not exactly known. Accordingly, designers have not been able to accurately calculate the material removal rate of CMP apparatuses for a range of configurations.

In light of the above, there is a need for a system and method for accurately calculating one or more of the factors that may influence the material removal rate. Additionally, there is a need for a system and method that can accurately calculate slurry flow in the gap and pressure of the slurry in the gap for a range of configurations. Further, there is a need for a new polishing rate model that takes in account a freshness of the slurry supplied to a given region of the polishing pad. Moreover, there is a need for a polishing apparatus that quickly and accurately polishes a substrate such as semiconductor wafers.

SUMMARY

The present invention is directed to a method for determining the flow of a fluid in a gap between a pad and a substrate. In one embodiment, the present invention utilizes a hybrid Navier-Stokes/lubrication theory formulation to calculate the flow of the fluid in at least a portion of the gap for at least one time step. For example, the gap can be divided into a plurality of elements. In this example, the present invention can utilize the hybrid Navier-Stokes/lubrication formula to calculate the fluid flow and pressure of the fluid at each element at a plurality of time steps.

Additionally, in one embodiment, the present invention provides a method to track and estimate the composition of the fluid at various locations and/or times in the gap. For example, the composition of the fluid can be estimated at one or more of the elements at one or more time steps.

Moreover, in one embodiment, the present invention provides a material removal rate model that attempts to account for the effects of the fluid flow in the gap, the hydrostatic pressure in the gap and the composition of the fluid in the gap.

The present invention is also directed to (i) an apparatus that accurately calculates relative velocity at a number of locations between a rotating pad and a substrate, (ii) an apparatus that accurately calculates fluid flow in the gap and pressure of the fluid in the gap for a range of configurations, (iii) an apparatus that calculates a freshness of the fluid supplied to a given region of a polishing pad, and (iv) an apparatus that utilizes a new polishing rate model. Additionally, the present invention is directed to an object or wafer that has been polished by the methods or apparatuses provided herein.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
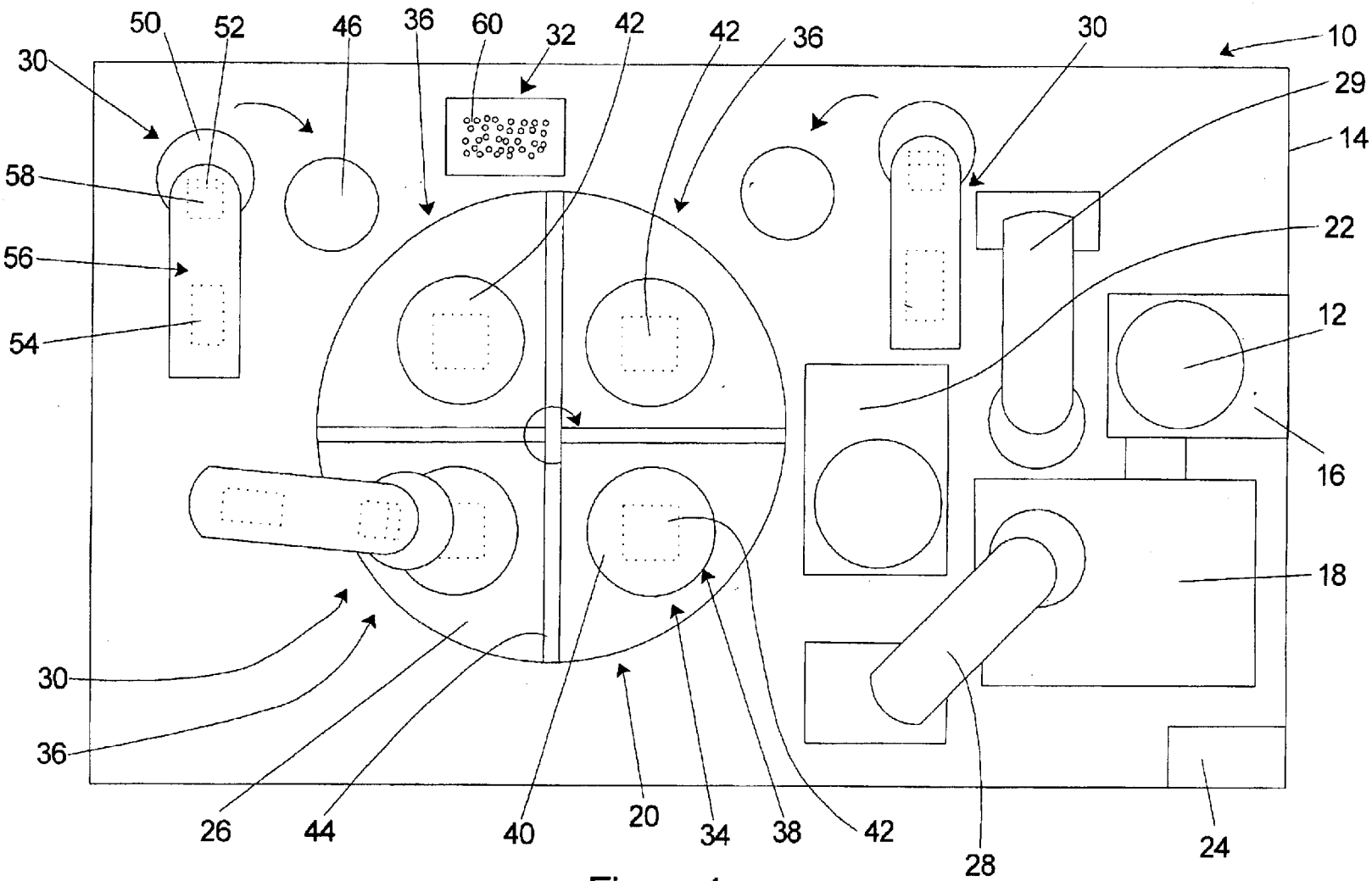
FIG. 1 is a schematic illustration of an apparatus having features of the present invention.

FIG. 1 illustrates a top plan illustration of a precision apparatus 10 having features of the present invention. For example, the apparatus 10 can be used for the preparation, cleaning, polishing, and/or planarization of a substrate 12. The design of the apparatus 10 and the type of substrate 12 can vary. In the embodiment illustrated in FIG. 1, the apparatus 10 is a Chemical Mechanical Polishing system that is used for the planarization of a semiconductor wafer 12. Alternatively, for example, the apparatus 10 can be used to clean and/or polish another type of substrate 12, such as bare silicon, glasses, a mirror, or a lens.

As provided below, in one embodiment, the present invention is directed to an apparatus 10 and method for accurately calculating one or more of the factors that may influence the material removal rate of the apparatus 10. For example, the present invention provides a method for accurately calculating slurry flow in a gap and pressure of the slurry in the gap for a range of configurations.

In FIG. 1, the apparatus 10 includes a frame 14, a loading station 16, a cleaning station 18, a polishing station 20, a receiving station 22, and a control system 24. The frame 14 supports the other components of the apparatus 10.

The loading station 16 provides a holding area for storing a number of substrates 12 that have not yet been prepared for their intended purpose. For example, the substrates 12 can be unplanarized and unpolished. The substrates 12 are transferred from the loading station 16 to the receiving station 22. The substrate 12 is then transferred to the polishing station 20 where the substrate 12 is planarized and polished to meet the desired specifications. After the substrate 12 has been planarized and polished, the substrate 12 is then transferred through the receiving station 22 to cleaning station 18. The cleaning station 18 can include a rotating brush (not shown) that gently cleans a surface of the substrate 12. After the cleaning procedure, the substrate 12 is transferred to loading station 16 from where it can be removed from the apparatus 10 and further processed.

In the embodiment illustrated in FIG. 1, the polishing station 20 includes a polishing base 26, two transfer devices 28, 29, three polishing systems 30, and a fluid source 32. Alternatively, for example, the polishing station 20 can be designed with more than three polishing systems 30 or less than three polishing systems 30 or more than one fluid source 32.

The polishing base 26 is substantially disk shaped and is designed to be rotated in either a clockwise or counterclockwise direction about a centrally located axis. As shown in FIG. 1, the polishing base 26 can be designed to rotate in a clockwise direction about the axis to progressively and stepwise move the substrate 12 from a load/unload area 34 to each of three polishing areas 36 and then back to the load/unload area 34.

In the embodiment illustrated in FIG. 1, the polishing base 26 includes four holder assemblies 38 that each retain and rotate one substrate 12. Each holder assembly 38 includes a vacuum chuck or gimbaled substrate holder 40 that retains one substrate 12 and a substrate rotator 42 (illustrated in phantom) that rotates the substrate holder 40 and the substrate 12 about a substrate axis of rotation during polishing. Additionally, the polishing base 26 includes a "+" shaped divider that separates the substrate holders 40.

The substrate rotator 42 can be designed to rotate the substrate 12 in the clockwise direction or the counter clockwise direction. In one embodiment, the substrate rotator 42 includes a motor that selectively rotates the substrate 12 between approximately negative 400 and 400 revolutions per minute.

In FIG. 1, each holder assembly 38 holds and rotates one substrate 12 with the surface to be polished facing upward. Alternatively, for example, the polishing station 20 could be designed to hold the substrate 12 with the surface to be polished facing downward or to hold the substrate 12 without rotating the substrate 12 during polishing.

The transfer device 29 transfers the substrate 12 to be polished from the receiving station 22 to the substrate holder 40 positioned in the load/unload area 34. Subsequently, the transfer device 28 transfers a polished substrate 12 from the substrate holder 40 positioned in the load/unload area 34 through the receiving station 22 to the cleaning station 18. The transfer devices 28 and 29 can include a robotic arm that is controlled by the control system 24.

The polishing station 20 illustrated in FIG. 1 includes three polishing systems 30, each of the polishing systems 30 being designed to polish the substrate 12 to a different set of specifications and tolerances. By using three separate polishing systems 30, the apparatus 10 is able to deliver improved planarity and step height reduction, as well as total throughput. The desired polished profile can also be changed and controlled depending upon the requirements of the apparatus 10.

The design of each polishing system 30 can be varied. In FIG. 1, each polishing system 30 includes a pad conditioner 46; a polishing pad 48 (illustrated in FIG. 3); a pad holder 50; a pad rotator 52 (illustrated in phantom); a lateral mover 54 (illustrated in phantom); a polishing arm 56 that moves the pad 48 between the pad conditioner 46, and a location above the substrate 12 on the polishing base 26; a pad vertical mover 58 (illustrated in phantom); and a detector (not shown) that monitors the surface flatness of the substrate 12. In this embodiment, each polishing system 30 holds the pad 48 facing downward. However, the apparatus 10 could be designed so that one or more of the pads 48 is facing upward.

The pad conditioner 46 conditions and/or roughens the pad 48 so that the pad 48 has a plurality of asperities and to ensure that the pad 48 is uniform.

The pad holder 50 secures the polishing pad 48. The pad holder 50 also includes one or more fluid outlets (not shown in FIG. 1) for directing fluid from the fluid source 32 into a gap (illustrated in FIG. 4) between the pad 48 and the substrate 12. The number and location of the fluid outlets can be varied. For example, the pad holder 50 can include one centrally located fluid outlet. Alternatively, the pad holder 50 can include a plurality of spaced apart fluid outlets. In one embodiment, the pad holder 50 is gimbaled and applies a load without supporting a moment.

Pad rotator 52 rotates the pad 48. The rotation rate can vary. In one embodiment, the pad rotator 52 includes a motor that selectively rotates the pad 48 at between approximately negative 800 and 800 revolutions per minute.

The pad lateral mover 54 selectively moves and sweeps the pad 48 back and forth laterally, in an oscillating motion relative to the substrate 12. This allows for uniform polishing across the entire surface of the substrate 12. In one embodiment, the pad lateral mover 54 moves the pad 48 laterally a distance of between approximately 30 mm and 80 mm and at a rate of between approximately 1 mm/sec and 200 mm/sec. However, other rates are possible.

The pad vertical mover 58 moves the pad 48 vertically and at least partly controls the pressure that the pad 48 applies against the substrate 12. In one embodiment, the pad vertical mover 58 applies between approximately 0 and 10 psi between the pad 48 and the substrate 12.

In one embodiment, the difference in relative rotational movement of the pad rotator 52 and the substrate rotator 42 is designed to be relatively high, approximately between negative 800 and 400 revolutions per minute. In this embodiment, the high speed relative rotation, in combination with relatively low pressure between the polishing pad 48 and the substrate 12 helps to enable greater precision in planarizing and polishing the substrate 12. Further, the pad 48 and the substrate 12 can be rotated in the same or opposite direction.

The fluid source 32 provides pressurized polishing fluid 60 (illustrated as circles) to the fluid outlet(s) into the gap between the pad 48 and the substrate 12. The type of fluid 60 utilized can be varied according to the type of substrate 12 that is polished. In one embodiment, the fluid 60 is a slurry that includes a plurality of nanoscale abrasive particles dispersed in a liquid. For example, the slurry used for chemical mechanical polishing can include abrasive particles comprised of metal oxides such as silica, alumina, titanium oxide and cerium oxide of a particle size of between about 10 and 200 nm in an aqueous solution. Slurries for polishing metals typically require oxidizers and an aqueous solution with a low pH (0.5 to 4.0). However, when planarizing an oxide layer, an alkali based solution (KOH or NH4OH) with a pH of 10 to 11 can be used.

The chemical solution in the slurry can create a chemical reaction at the surface of the substrate 12 which makes the surface of the substrate 12 susceptible to mechanical abrasion by the particles suspended in the slurry. For example, when polishing metals, the slurry may include an oxidizer to oxidize the metal because metal oxides polish faster compared to the pure metal. Additionally, the fluid 60 can also include a suspension agent that is made up of mostly water plus fats, oils or alcohols that serve to keep the abrasive particles in suspension throughout the slurry.

The rate of fluid flow and the pressure of the fluid 60 directed into the gap can also vary. In one embodiment, the fluid 60 is directed into the gap at a flow rate of between approximately 50 ml/sec and 300 ml/sec and at a pressure of between approximately 0 and 10 psi.

The control system 24 controls the operation of the components of the apparatus 10 to accurately and quickly polish the substrates 12. For example, the control system 24 can control (i) each substrate rotator 42 to control the rotation rate of each substrate 12, (ii) each pad rotator 52 to control the rotation rate of each pad 48, (iii) each pad lateral mover 54 to control the lateral movement of each pad 48, (iv) each pad vertical mover 58 to control the pressure applied by each pad 48, (v) the fluid source 32 to control the fluid flow in the gap.

The control system 24 can include one or more conventional CPU's and data storage systems. In one embodiment, the control system 24 is capable of high volume data processing.

Figure 2:
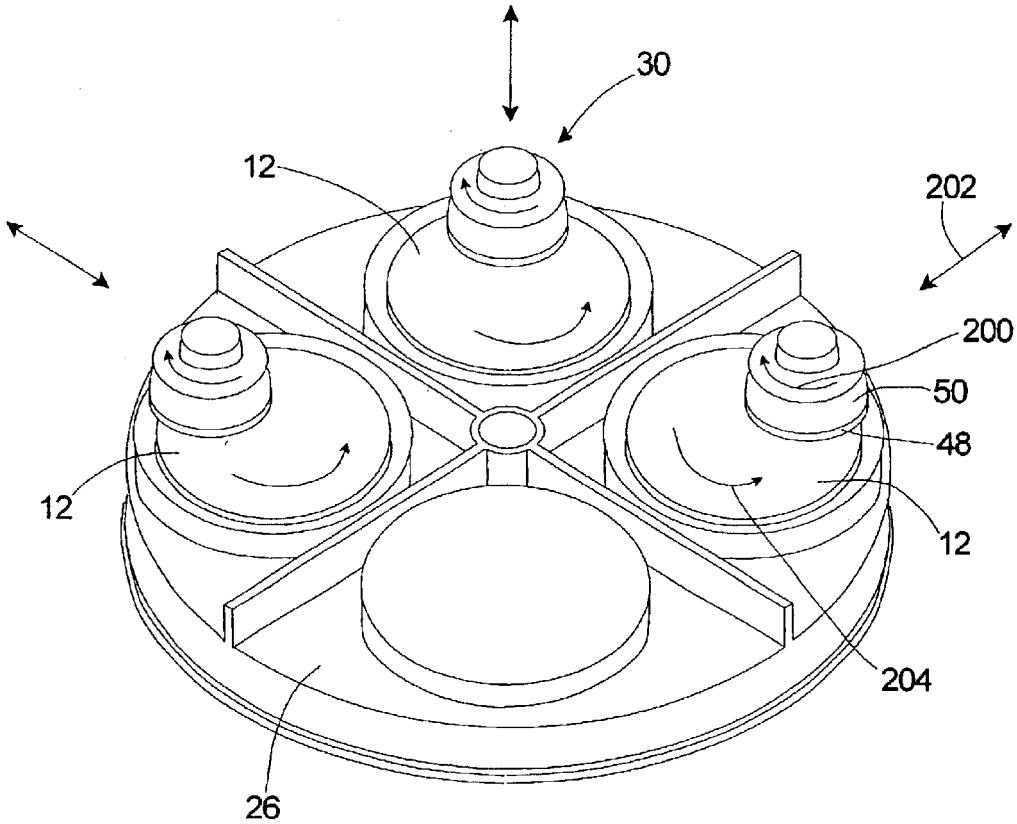
FIG. 2 is a perspective view of a portion of a polishing station of the apparatus of FIG. 1.

FIG. 2 illustrates a perspective view of a portion of the polishing station 30 of FIG. 1 and three substrates 12. More specifically, FIG. 2 illustrates the polishing base 26 and a portion of three polishing systems 30. In this embodiment, each of the pad holders 50 and pads 48 are rotated as indicated by arrows 200 and moved laterally as indicated by arrows 202 and each substrate 12 is rotated as indicated by arrows 204.

Figure 3:
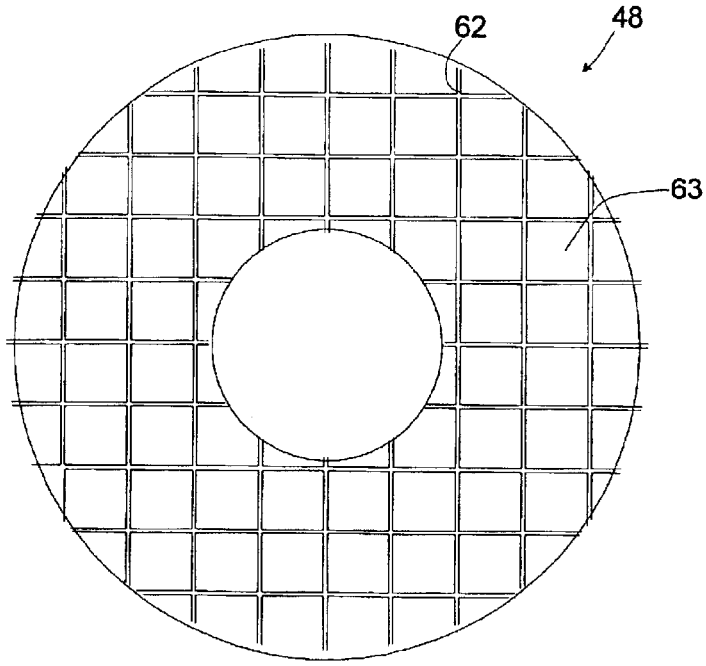
FIG. 3 is a bottom plan view of one embodiment of a pad having features of the present invention.

FIG. 3 is a bottom plan view of one embodiment of a polishing pad 48 that can be used in one or more of the polishing systems 30 in FIG. 1. In one embodiment, the polishing pad 48 is made of a relatively soft and wetted material such as blown polyurethane or similar substance. For example, the polishing pad 48 can be made of felt impregnated with polyurethane. The pad 48 is roughened to create a plurality of asperities on the polishing surface of the pad 48.

In this embodiment, the polishing pad 48 is flat, annular shaped and has an outer diameter of between approximately 260 mm and 150 mm and an inner diameter of between approximately 80 mm and 40 mm. Pads 48 within this range can be used to polish a wafer having a diameter of approximately 300 mm or 200 mm. Alternatively, the pad 48 can be larger or smaller than ranges provided above.

Additionally, in this embodiment, the polishing surface of the polishing pad 48 includes a plurality of grooves 62 positioned in a rectangular shaped grid pattern. Each of the grooves 62 has groove depth and a groove width. The grooves 62 cooperate to form a plurality of spaced apart plateaus 63 on the pad 48. The grooves 62 reduce pressure and hydrostatic lift in the gap. It should be noted that the groove 62 shape and pattern can be changed to alter the polishing characteristics of the pad 48. For example, each groove 62 can be a depth and a width on the order of between approximately 0.1 mm and 1.5 mm. Also, the grooves may be in a different pattern and shape. For example, a set of radial grooves combined with a set of circular grooves also could be utilized.

Alternatively, a pad 48 without grooves can be used in one or more of the polishing systems 30. Still alternatively, the pad 48 could be another type of substrate.

Figure 4:
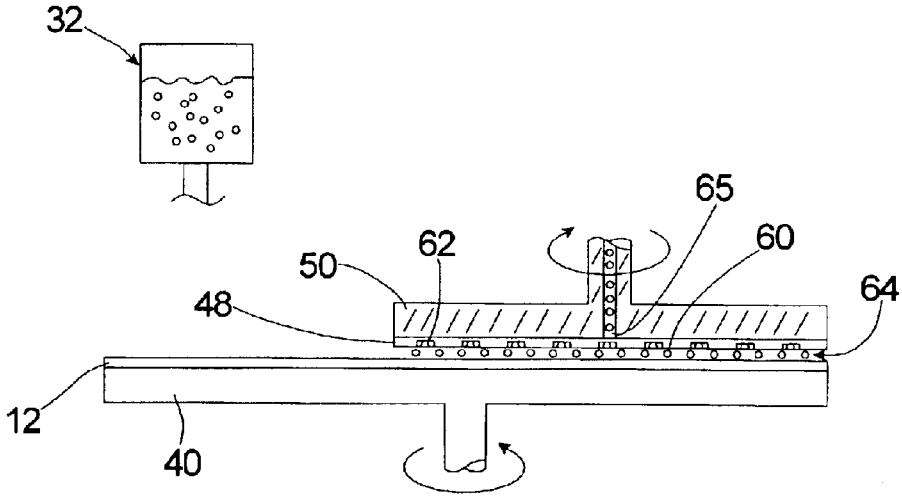
FIG. 4 is a side illustration of a substrate holder, a substrate, a pad holder (in cut-away), the pad, and a fluid supply having features of the present invention.

FIG. 4 is a side illustration of a portion of the substrate holder 40, the substrate 12, the pad holder 50 (in cut-away), the polishing pad 48, the fluid source 32, and a gap 64 (the gap size is greatly exaggerated in FIG. 4) between the pad 48 and the substrate 12. In this embodiment, the polishing pad 48 is relatively small in diameter compared to the substrate 12. This can facilitate high speed rotation of the pad 48. Additionally, the relatively small size of the polishing pad 48 results in a polishing pad 48 that is lightweight, with less pad deformity, which in turn allows for improved planarity. Alternatively, for example, the pad 48 can have an outer diameter that is greater than the outer diameter of the substrate 12.

The fluid 60 supplied under pressure through one or more fluid outlets 65 into the gap 64 generates hydrostatic lift under the pad 48 that reduces the load applied to the asperities of the pad 48. In one embodiment, the fluid 60 flows from near a central axis of the pad 48 through the grooves 62 and through the small gap 64 between the pad 48 and the substrate 12 under the action of the driving pressure and the relative motion of the pad 48 and the substrate 12. Alternatively, the fluid outlets 65 could be positioned at a larger radius and away from the central axis. In this embodiment, the fluid 60 would have an alternative flow pattern.

As provided herein, the grooves 62 in the pad 48 make a significant difference in the polishing rate. This is due to the effect of the grooves 62 on the pressure and flow distribution in gap 64. Additionally, as provided herein, the flow of the fluid 60 and the pressure of the fluid 60 in the gap 64 are believed to be very important in determining the material removal rate of the apparatus 10. The flow distributes the fluid 60 around the pad 48. Abrasive particles in the fluid 60 are pushed into the pad 48, fracture under the polishing load, or otherwise become unavailable as effective polishing elements. If part of the polishing pad 48 does not receive fresh abrasive particles from the fluid 60, it will cease to remove material from the substrate 12. Fluid flow calculations are also useful to determine if the fluid 60 is being supplied at the appropriate position and rate to improve the polishing rate and/or reduce the usage of fluid 60. Also, the pressure of the fluid 60 between the pad 48 and the substrate 12 reduces the load carried by pad asperities, and therefore reduces the polishing rate. Accordingly, the accurate calculation of the fluid flow rate and the pressure distribution in the gap 64 appear to be important to the accurate prediction of polishing rate.

A couple of types of simulation algorithms for fluid flow were initially evaluated. One type uses a discretized representation of the three dimensional Navier-Stokes equations. However, a Navier-Stokes solution for the full pad 48 would be prohibitively expensive and prohibitively time consuming. Another type of fluid flow simulation uses the two dimensional lubrication equations to simulate fluid flow. Unfortunately, the lubrication equations alone do not provide an accurate flow simulation for a grooved pad 48 with realistic pad/substrate relative velocities.

As an overview, the present invention utilizes lubrication equations modified to account for a grooved pad 48 to calculate fluid flow in the gap 64. More specifically, as provided herein, the grooves 62 are accounted for by performing detailed Navier-Stokes simulations for small pad elements containing the grooves 62. The simulation results give the flow through a pad element as a function of pressure gradient and pad/substrate relative velocity. The fluid flow simulation allows for the calculation of the hydrostatic lift force caused by the fluid 60 fed directly into the gap 64. Additionally, a new polishing rate model is provided herein that accounts for the composition of the fluid 60 in a given region of the pad 48.

Flow Simulation Method

In one embodiment, the present invention provides a method, e.g. a simulation algorithm that calculates and estimates the flow distribution of the fluid 60 in the gap 64 between the polishing pad 48 and a substrate 12 that is being polished. The new algorithm is a hybrid Navier-Stokes/lubrication formulation. The method is based on a 2-D finite element method applied to the lubrication equations.

In one embodiment, the simulation method is used to calculate the flow of the fluid 60 in the gap 64 at a series of discrete time steps T over a simulation period. The calculated flow at each of these discrete time steps T can be used to represent the flow of the fluid 60 in the gap 64 during the simulation period. In one embodiment, for example, the flow simulation method can be used to independently calculate the fluid flow in the gap 64 at time steps $T_1$, $T_2$, $T_3$, $T_4$ . . . $T_x$.

The simulation period, the number of time steps and the magnitude of the time interval that separates each time step can be varied. In most cases, increasing the number of time steps in which calculations are performed and decreasing the time interval that separates each time step may enhance the accuracy of the slurry particle tracking in the gap during the simulation period. However, at a certain level, it may be prohibitively too time consuming or the benefit of decreasing the time interval and increasing the number of time steps will not change the slurry particle tracking results.

In one embodiment, (i) the simulation period is approximately equal to the time that it takes to make 10 complete revolutions of the pad 48 while sweeping back and forth over the substrate 12, (ii) the number of time steps is approximately equal to 3600, and (iii) the time interval is approximately equal to the time it takes the pad 48 to rotate about 1 degree. Alternatively, for example, (i) the simulation period can be any amount of time representative of the full polishing process, (ii) the number of time steps can be approximately equal to 360, 1000, 10000, or 36000 and/or (iii) the time interval can be approximately equal to the time it takes the pad 48 to rotate about 2, 3, 4, or 5 degrees.

Figure 5A:
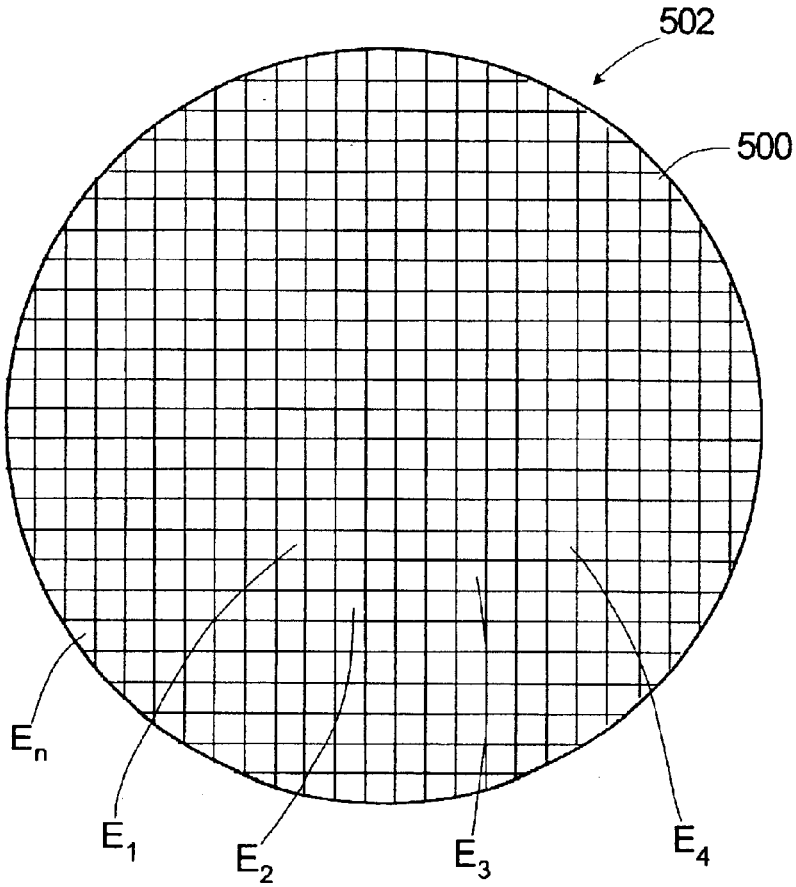
FIG. 5A is one embodiment of a layout of computational elements used for fluid flow calculations.

FIG. 5A is a schematic illustration of a circular shaped flow region 502 that represents the possible area for fluid flow between the pad 48 (illustrated in FIG. 4) and a substrate 12 (illustrated in FIG. 4) when the pad 48 is completely positioned over the substrate 12. The present invention divides the flow region 502 into a set of individual elements 500, namely E1, E2, E3, E4 . . . EN. The number of individual elements 500 can be varied. In one embodiment, the gap 64 is divided into 900 individual elements 500. In alternative embodiments, for example, the gap 64 can be divided into approximately 100, 200, 300, 400, 500, 600, 700, 800, 1000, 1100, 1200, 1300, 1400, or 1500 elements 500. However, the gap 64 could be divided into more or less elements 500 if necessary. The number of elements required will depend on the groove geometry and spacing.

Figure 5B:
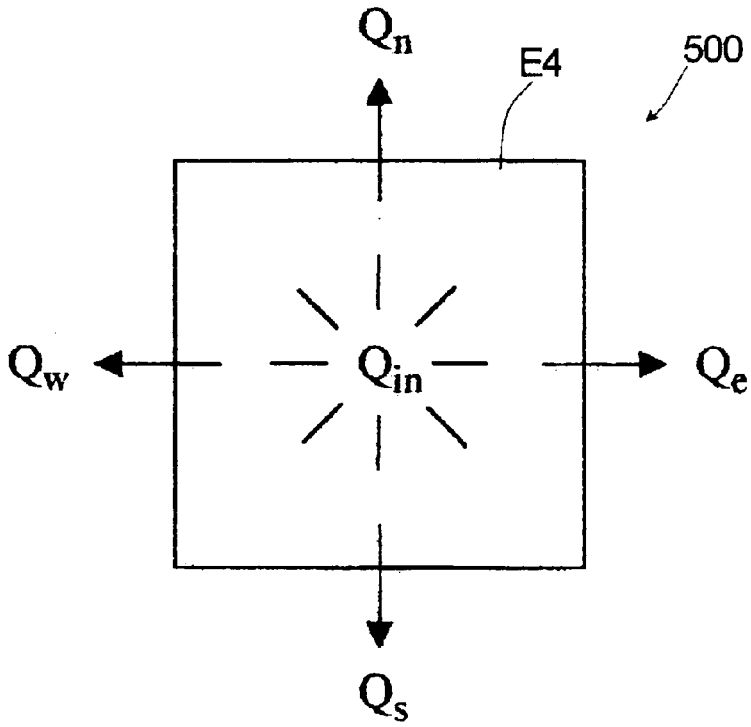
FIG. 5B is an illustration of volume flow rates associated with one computational element.

First, an equation expressing the conservation of mass is written for each element 500 illustrated in FIG. 5A. FIG. 5B is an enlarged view of one of the elements 500, namely element E4. Assuming incompressible flow and quasi steady flow at each element 500, the equation for conservation of mass for each element 500 can be written as:

$$Q_n+Q_s+Q_w+Q_e=Q_{in} \qquad \text{Equation 1}$$

where the $Q_n$, $Q_s$, $Q_w$, $Q_e$ are volume flow rates across the sides of the flow element 500, and $Q_{in}$ is the flow into the element 500 from the fluid source 32 (illustrated in FIG. 4) via the fluid outlet(s). It should be noted that the fluid outlet(s) do not direct fresh fluid directly into a number of the elements 500. Thus, $Q_{in}$ is equal to zero for a number of the elements 500. Stated another way, $Q_{in}$ is equal to zero, unless the element 500 is positioned at one of the fluid outlet(s).

Figure 6:
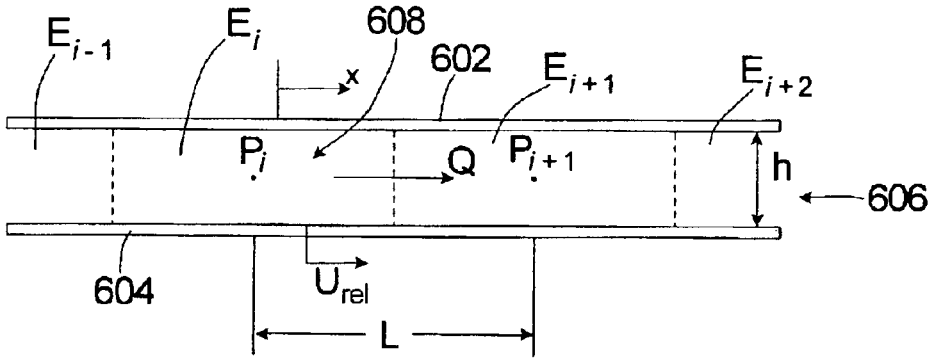
FIG. 6 is a simplified illustration of one flow computational element with a smooth pad.

In lubrication theory, the volume flow rates ($Q_n$, $Q_s$, $Q_w$, $Q_e$) are found by integrating the analytical velocity profile, which is a combination of Poiseuille and Couette flows. The flow rate depends on the pressure gradient, the relative velocity between the two adjacent surfaces, and the gap between the two surfaces. FIG. 6 illustrates a planar shaped first surface 602 and a planar shaped second surface 604 that are separated by a gap 606. The gap 606 can be divided into a plurality of elements 608. Elements $E_i$ and $E_{i+1}$, and portions of elements $E_{i+2}$ and $E_{i-1}$ are illustrated in FIG. 6. In this embodiment, the flow rate Q from element $E_i$ to element $E_{i+1}$ can be calculated as follows:

$$Q = \frac{1}{2}U_{rel}hL - \frac{1}{12}\frac{\partial p}{\partial x}\frac{h^3 L}{\mu}. \quad \text{Equation 2}$$

In Equation 2, $U_{rel}$ is equal to the relative velocity of the two surfaces 602, 604, h is the height of the gap 606; L is equal to the length (illustrated from center point to center point of adjacent elements) of each element 608; $\mu$ is equal to the absolute viscosity of the fluid in the gap 606; and $\partial p/\partial x$ is the pressure gradient between element $E_i$ and element $E_{i+1}$. Here the reference frame has been taken fixed to the upper surface 602. Note that the Couette term (the first term on the right side of Equation 2) represents the flow due to the differential motion of the two surfaces 602, 604 and the Poiseuille term (the second term on the right side of Equation 2) represents the pressure-driven flow. In Equation 2, these terms are superposed linearly. Also note that the equation is linear in the pressure. For the numerical implementation, the pressure gradient term can be represented simply as:

$$\frac{\partial p}{\partial x} \approx \frac{p_{i+1} - p_i}{L} \quad \text{Equation 3}$$

where $P_i$ is the pressure at the center of element $E_i$ and $P_{i+1}$, is the pressure at the center of element $E_{i+1}$. Thus, the flow rate Q from element $E_i$ to element $E_{i+1}$ can be calculated as follows:

$$Q \approx \frac{1}{2}U_{rel}hL - \frac{p_{i+1} - p_i}{12\mu}h^3. \quad \text{Equation 4}$$

Using this expression, an equation similar to Eqn. 1 can be written for each element 500 in the flow domain. For each time step ($T_1$–$T_x$), this results in a set of N linear algebraic equations in the pressures, where N is the total number of flow elements. This set of equations can be solved using standard methods of linear algebra to find the pressures, and thus the fluid flowrates.

Unfortunately, equations 2–4 represent flow between two flat surfaces. These equations are not believed to accurately calculate the fluid flow rates for a grooved surface. Thus, although these flow equations may be useful for calculating flow rates for a pad not having grooves, these flow calculations may not accurately calculate the flow rate for a pad 48 that includes grooves 62, like the pad 48 illustrated in FIG. 3.

Figure 7A:
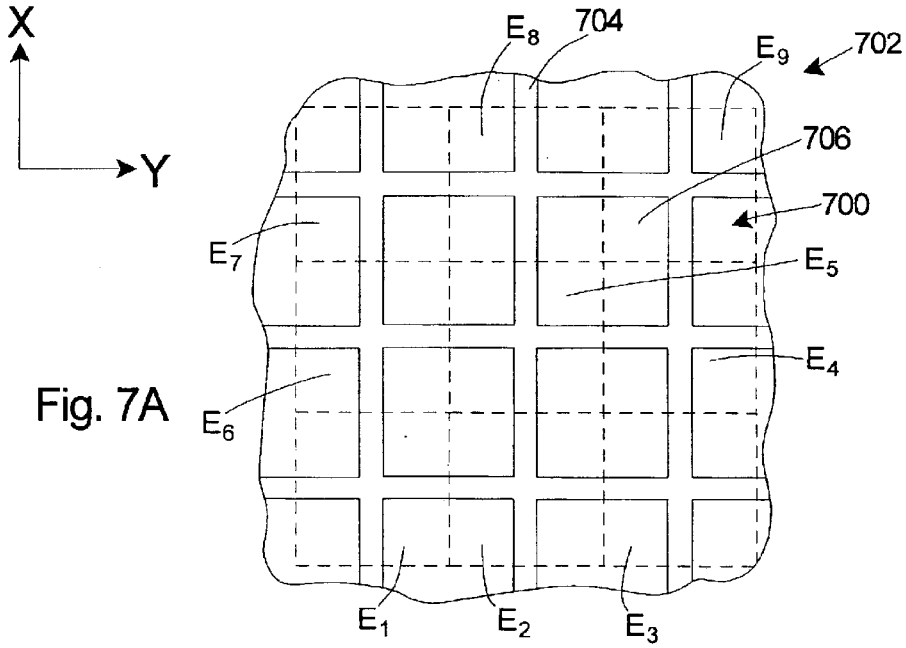
FIG. 7A is an illustration of a plurality of computation elements positioned relative to a portion of a flow region.

FIG. 7A is a more accurate illustration of how a portion of the flow region 702 may appear between the grooved pad 48 and the substrate 12 of FIG. 4. In this embodiment, the flow region 702 includes a rectangular grid shaped deep region 704 that separates a plurality of spaced apart shallow regions 706. The deep region 704 represents the area between the pad 48 and the substrate 12 at the grooves 62 and the shallow regions 706 represents the area between the pad 48 and the substrate 12 at the plateaus.

FIG. 7A also illustrates that in one embodiment, the flow region 702 is divided into a plurality of square shaped flow elements 700 indicated by dashed lines. More specifically, flow elements $E_1$, $E_2$, $E_3$, $E_4$, $E_5$, $E_6$, $E_7$, $E_8$, and $E_9$ are illustrated in FIG. 7A. However, the entire flow region 702 can be divided into elements 700 $E_1$, $E_2$, $E_3$, $E_4$ . . . $E_N$.

Figure 7B:
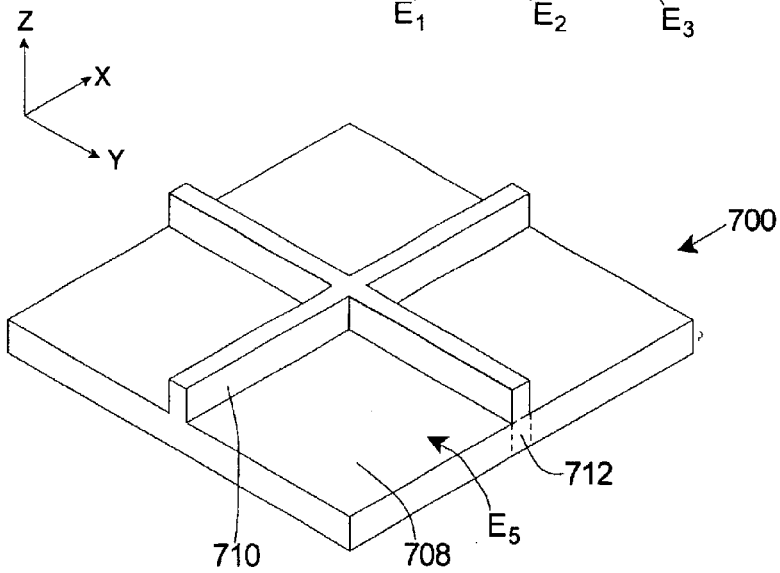
FIG. 7B is a perspective view of one of the computation elements of FIG. 7A.
Figure 7C:
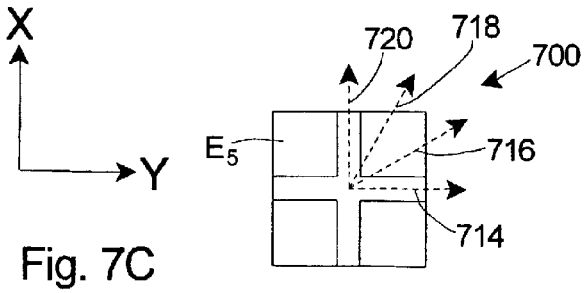
FIG. 7C is a top view of one computation element of FIG. 7A.

FIG. 7B illustrates a perspective view and FIG. 7C illustrates a top view of one of the elements 700 (E5) of FIG. 7A. In this embodiment, each flow element 700 includes a "+" shaped deep region 704 and four spaced apart shallow regions 706. Alternatively, for example, each element 700 could have another shape or orientation.

Initially, an approximate lubrication theory equation is determined that will represent the flow from each flow element 700 illustrated in FIGS. 7A–7C. First, referring to FIG. 7B, the fluid flow is divided into (i) a first part 708 which flows between the substrate and the plateaus on the pad, (ii) a second part 710 which flows through the groove (not shown in FIG. 7B), and (iii) a third part 712 (illustrated with dashed lines) which flows above the groove in the pad/substrate gap. Taking the gap between the plateaus and the substrate as h, the depth of the groove as d, the width of the groove as w, and the total length and width of the element 700 as L, the present invention provides a lubrication type equation that provides the approximate fluid flow from one of the elements 700 to an adjacent element as follows:

$$Q \approx \frac{1}{2}U_{rel}\left[(h+d)\cdot w\cdot g\left(\frac{d}{w}\right) + h\cdot(L-w)\right] - \frac{p_{i+1} - p_i}{\mu\cdot L}\left[\frac{w^3 d^3}{8(w+d)^2} + \frac{Lh^3}{12} + \frac{wh^3}{6}\right] \quad \text{Eqn. 5}$$

Figure 7D:
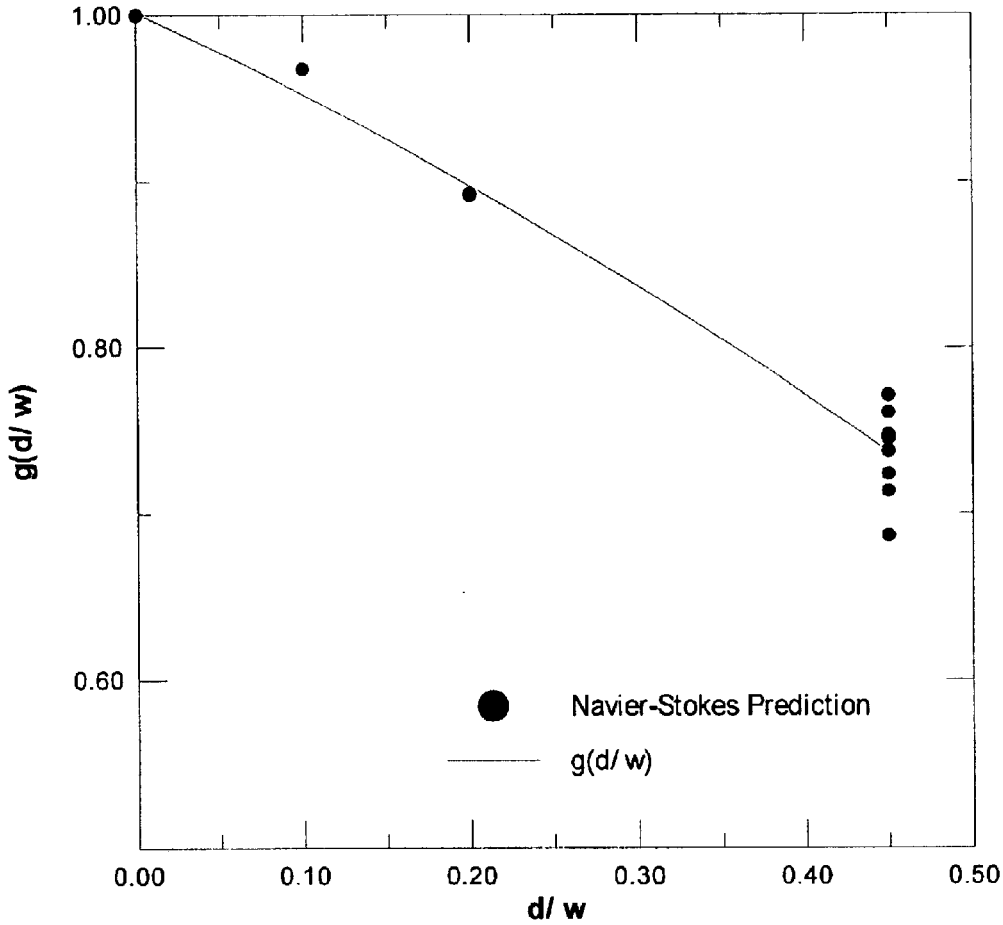
FIG. 7D is a plot that illustrates values of function g for different groove aspect ratios.

In Eqn. 5, $U_{rel}$ is the relative velocity of the pad and substrate at the particular element 700; $P_{i+1}$, is the pressure at the center of the adjacent element; $P_i$ is the pressure at the center of element; and $\mu$ is the absolute viscosity of the fluid. Additionally, g is an empirical function of the groove aspect ratio, d/w, fit to flow data from computations of different groove aspect ratios. A plot of g(d/w) is shown in FIG. 7D for the case of a rectangular groove cross-section. A similar function could be determined for other groove cross-sections. For example, in FIG. 7D, the value of g is 1 when the groove depth is zero.

Note that Eqn. 5 works well for estimating flow along the x direction when the pressure gradient and relative velocity are substantially parallel to the groove aligned with the x-axis. For Eqn. 5, it is assumed that the flows in the two directions (x direction and y direction) linearly superpose. More specifically, it is assumed that the flow of the fluid in the x direction is independent of any relative velocity or pressure gradient in the y direction.

The assumptions embodied in Eqn. 5 were tested using a full three-dimensional Navier-Stokes simulation of the flow in a single element 700 exposed to a range of relative velocities and pressure gradients. The Navier-Stokes solutions were calculated using a commercial computational fluid dynamics (CFD) code, sold under the trademark Fluent. A typical grid for the calculations had 150,000 elements. The results were in excellent agreement with Eqn. 5 at low relative velocities between the pad and substrate. More specifically, the assumptions embodied in Eqn. 5 are relatively accurate (e.g. within a few percent) when the relative velocity between the pad and the substrate is less than 1 m/s.

The accuracy of flow calculations determined using Eqn. 5 decreases as the relative velocity exceeds 1 m/s. For example, at relative velocities greater than 3 m/s, the flowrates in the two directions (x and y) are no longer independent. More specifically, a strong flow in the y direction results in a substantial reduction in the flow in the x-direction below the level indicated by flow calculation using Eqn. 5. As the relative velocity is increased, cross flow relative to the groove caused flow separation and blockage within the groove.

The discussion above applies to a slurry with an absolute viscosity of 0.005 $Ns/m^2$(5 centipoise) and a density of 1000 kg/m$^3$. The same approach is appropriate for slurries of different viscosity. To apply this present approach to a slurry of a different viscosity, the relative velocity must be expressed in terms of a dimensionless Reynolds number:

$$Re=\rho U_{rel} d/\mu$$

In this equation ρ is the density of the slurry typically expressed in kg/m$^3$, $U_{rel}$ is the relative velocity between the pad and the wafer, d is the groove depth, and $\mu$ is the absolute viscosity of the slurry.

To account for the Reynolds number and direction effects, the present invention adds another empirical function to Eqn. 5. More specifically, a function determined by Navier-Stokes simulation was added to the lubrication type formula of Eqn. 5. In one embodiment, the function is referred to as a flow fraction "ff". Eqn. 6 below is the resulting hybrid Navier-Stokes/lubrication equation. The modified volumetric flow equation becomes $$Q \approx ff(U_{rel}, \theta)\frac{1}{2}U_{rel}\left[(h+d)\cdot w\cdot g\left(\frac{d}{w}\right)+h\cdot(L-w)\right]-\frac{p_{i+1}-p_i}{\mu\cdot L}\left[\frac{w^3d^3}{8(w+d)^2}+\frac{Lh^3}{12}+\frac{wh^3}{6}\right] \quad \text{Equation 6}$$

Eqn. 6 is believed to be accurate for relative velocities up to 10 m/s at any shearing angle relative to the axis of the groove, for a gap height of 10 microns. The same equation is valid for other higher relative velocities and different gap heights. New empirical functions ff and g are calculated in the same manner as above. It should be noted that the effect of the asperity roughness on the fluid flow is neglected in equation 6. This roughness is likely to have a significant effect on the fluid flow above the pad plateaus. However, the plateau regions are believed to contribute only a minor fraction of the total fluid flow. Since the Reynolds number of a typical pad asperity is very small, the asperities are unlikely to have a significant effect on the larger scale flow features around the pad grooves.

In Eqn. 6, the flow fraction compensates for the fraction of flow that is inhibited from flowing because of flow separation and blockage within the groove. Stated another way, the flow fraction accounts for the Reynolds number and directional effects of pressure gradients and relative velocities relative to the grooves. The value of the flow fraction will vary according to the flow angle relative to the grooves and the relative velocity of the pad/substrate. In one embodiment, the flow fraction function is calculated using a full three-dimensional solution of the Navier-Stokes equations calculated for a single flow element 700.

Figure 8:
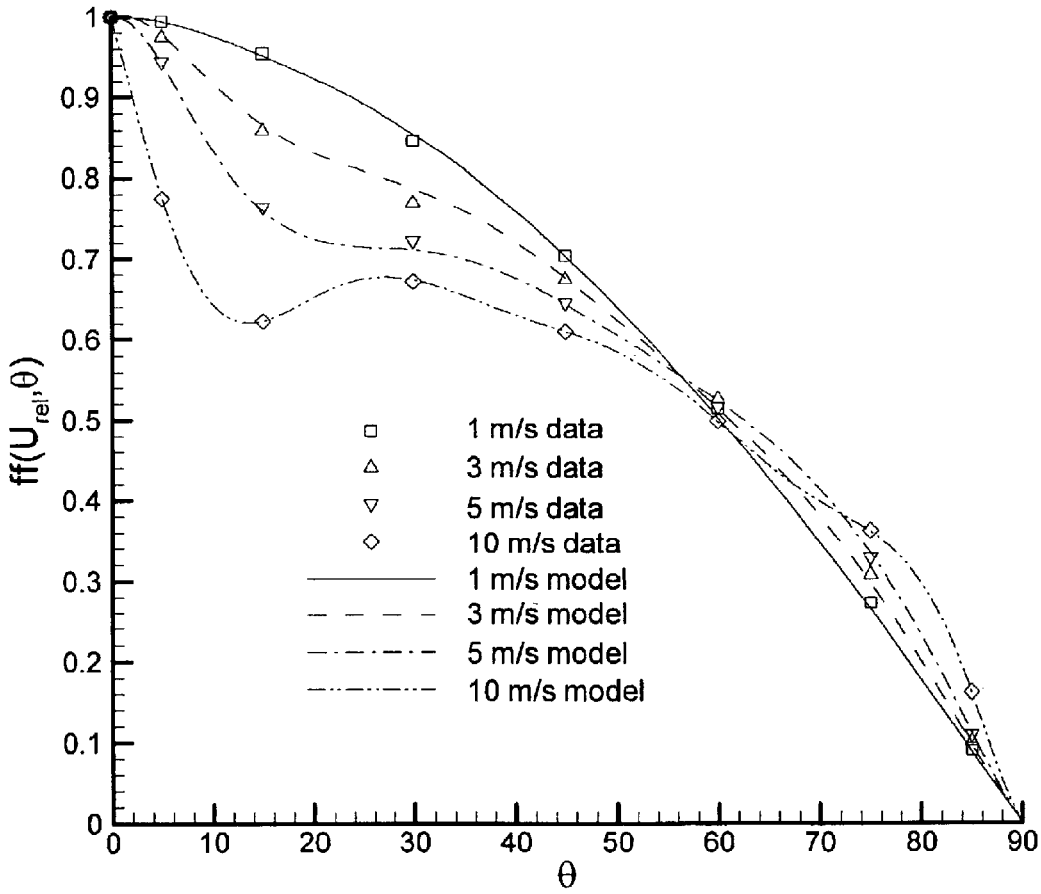
FIG. 8 is a graph that illustrates flow fraction factor versus angle and relative volocity.

FIG. 8 is a graph that illustrates the flow fraction in view of the angle relative to the groove, for a plurality of relative velocities. The values in the graph were calculated using detailed Navier-Stokes solutions using a commercial CFD code, sold under the trademark Fluent with a single element that is similar to the element 700 illustrated in FIG. 7B. The data shows the highly non-linear behavior of the flow for velocities above 3 m/s and help to underscore the importance of the computations in developing our flow simulation. This same method could be used for any periodic pattern of grooves or different groove shapes. For example, triangular grooves, rounded grooves, or trapezoidal grooves could be accommodated. More specifically, separate Navier-Stokes solutions will be needed for a different groove geometry.

In FIG. 8, the flow fraction varies from 1 to 0. The graph in FIG. 8 can probably best be understood with concurrent reference to FIG. 7C. More specifically, FIG. 7C includes a plurality of dashed arrows, including a first arrow 714, a second arrow 716, a third arrow 718, and a fourth arrow 720. Each arrow represents an alternative wafer velocity relative to the element 700. More specifically, the first arrow 714 represents relative velocity parallel with the Y axis and the groove aligned with the Y axis. Somewhat similarly, (i) the second arrow 716 represents relative velocity that is at an approximately 30 degree angle relative to the Y axis, (ii) the third arrow 718 represents relative velocity that is at an approximately 60 degree angle relative to the Y axis, and (iii) the fourth arrow 720 represents relative velocity that is at an approximately 90 degree angle relative to the Y axis, parallel to the X axis and parallel with the groove aligned with the X axis. Referring also to FIG. 7A, in this example, in order to determine the fluid flow Q from the flow element $E_5$ to $E_4$, the angle of the relative velocity relative to the Y axis is determined. For example, from the graph of FIG. 8, if the relative velocity angle is 30 degrees (similar to the second arrow 716) and the relative velocity magnitude is 5 m/s, the value of ff is approximately 0.7. Alternatively, if the relative velocity is 60 degrees (similar to the third arrow 718) and the relative velocity magnitude is 3 m/s, the value of f is approximately 0.5.

Implementation

The first step in the flow simulation is to choose the pad flight height h. In principle, the flight height could be calculated by coupling the flow calculation to a code which calculates the load borne by the asperities. However, in the absence of measurements for this geometry, a fixed pad flight height of the order of 10 microns was chosen. The overall results appear to be relatively insensitive to this selection.

The next step is to determine the relative velocity of the pad and substrate for each element 700. As provided herein, a geometry calculator (computer program) can be used to solve a number of geometric equations to calculate the relative velocity of the pad and substrate at each element 700 for each time step, and the orientation of the relative velocity relative to the grooves of each element 700 for each time step. The relative velocity includes the effects of pad rotation, substrate rotation, and any translation of the pad relative to the substrate. A geometry calculator determines what fraction of the substrate is covered by the pad at each radial position on the substrate for each time step. The geometry calculator is a computer program that uses standard geometric relationships to calculate position and velocity of every element of the pad.

The present invention calculates flow by solving the system of equations for each of the elements 700 based on Eqns. 1 and 6 for the prescribed relative velocity distribution. The values for ff are taken from the curve fit formulas as shown in FIG. 8. Pressure and flow statistics are recorded and then time is advanced. The flow is assumed to be quasi-steady during each discrete time step. The pad and substrate positions and orientations are updated and the system of equations is solved again for each of the time steps. Typically 10 revolutions are simulated to produce converged statistics.

Stated another way, Eqns. 1 and 6 can be written and solved for each element 700 $E_1$–$E_N$ at each time step $T_1$–$T_x$ to simulate flow in the gap during the time steps.

Solving equations 1 and 6 for each element and each time step provides detailed information regarding fluid flow and hydrostatic pressure at each element that can be used for other calculations, such as material removal rate.

The method provided herein is very efficient. A simulation of a pad undergoing 10 complete revolutions while sweeping back and forth over the substrate can be completed in a short time on a desktop computer. The algorithm was developed and tested for the Chemical-Mechanical Polishing (CMP) systems that use a rotating polishing pad pressed against a wafer that may be either rotating or stationary.

Fluid Flow Results

Figure 9A:
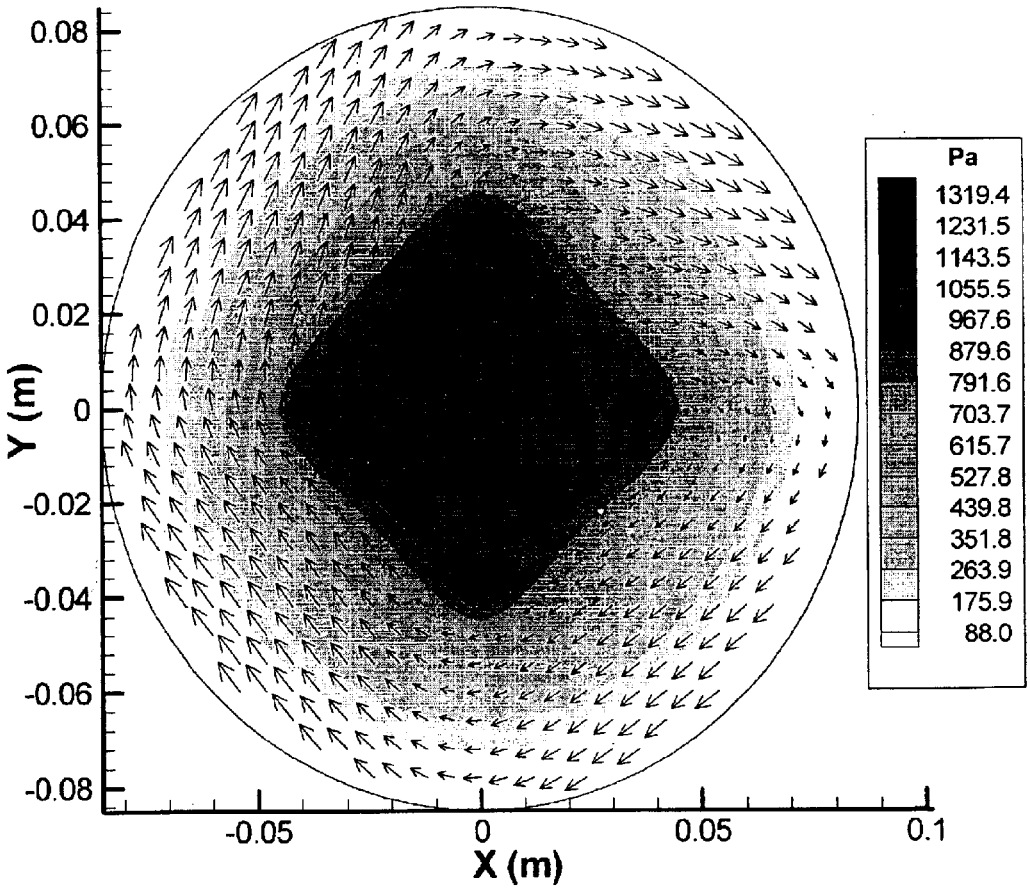
FIG. 9A is a graph that illustrates fluid velocity vectors and pressure contours for one embodiment of a pad at one time step.

FIG. 9A illustrates a fluid velocity distribution and pressure distribution in the gap at one time step that is calculated by solving Eqns. 1 and 6 for all of the elements. The fluid velocity is illustrated by arrows and the pressure distribution is illustrated by shading. Darker shading represents higher pressure. For this case, a fixed gap of 10 microns was chosen. The pad rotation speed was −100 rpm and the substrate rotation was 100 rpm. Fluid was introduced at four fluid outlets indicated by the small circles in FIG. 9A. Note that there is a local pressure maximum at each fluid outlet.

It is apparent from FIG. 9A, with this set of operating conditions, that several regions of the pad would be starved of fresh fluid. For example, there is almost no fluid flow into the region around x=5 cm and y=0 cm. This may not necessarily be a problem. As the pad rotates and translates, the relative velocity will be different and this region may be supplied with fresh fluid.

It should be noted that plots for subsequent time steps can be created by solving Eqns. 1 and 6 for all of the elements.

Figure 9B:
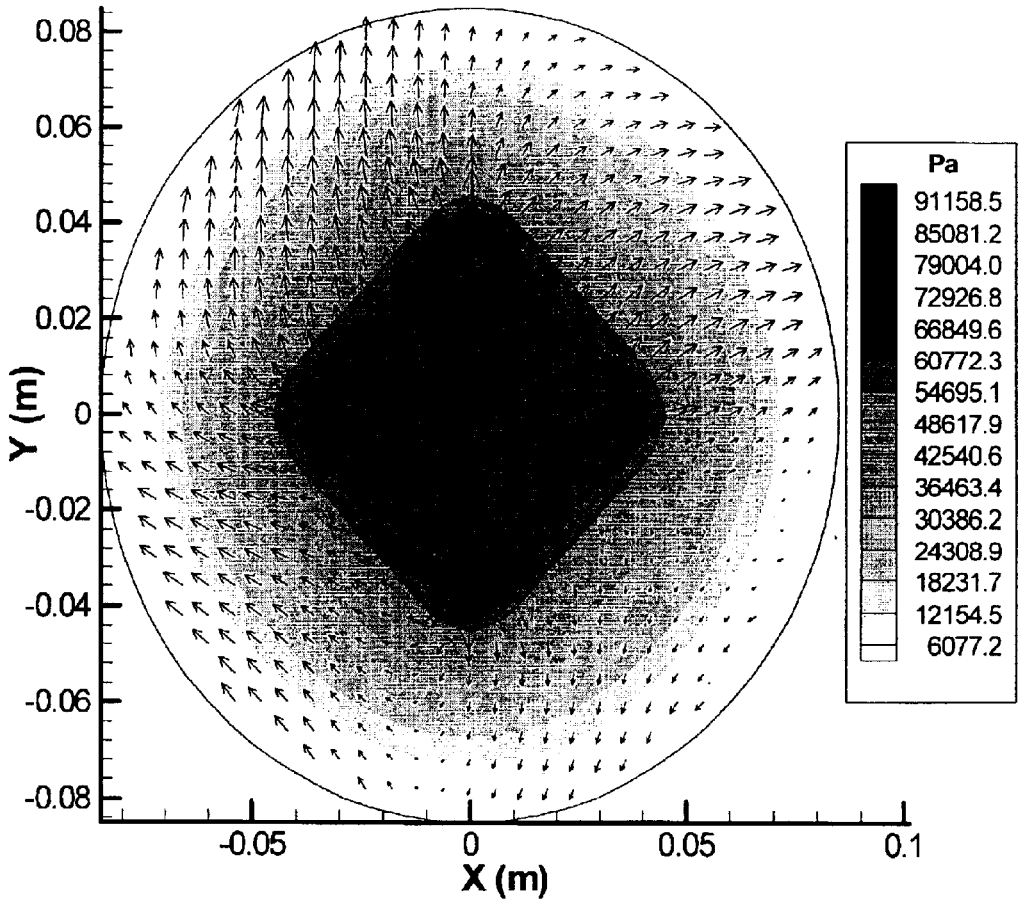
FIG. 9B is a graph that illustrates fluid velocity vectors and pressure contours for another embodiment of a pad at one time step.

FIG. 9B illustrates the same type of plot for a case in which the groove depth has been reduced by a factor of 5. In typical applications, the pad thickness decreases substantially before it is discarded. Note that the velocity vectors in FIG. 9B are oriented more in the radial direction. The vector scale is the same as in FIG. 9A. Also, the pressure contours indicate far higher pressure levels than in the previous plot. This higher pressure level produces a substantial hydrostatic lift that may lift at least some of the pad asperities entirely free from the substrate surface.

It has been determined that as a pad wears, there is little effect on the polishing performance until the groove depth falls below a threshold level. At that point, the polishing rate drops dramatically. This is explained by the hydrostatic lift. The lift calculated as provided above, increases approximately as the inverse cube of groove depth. Therefore, the lift appears to suddenly increase very rapidly at a critical value of the groove depth.

It should be noted that the flow calculation method provided herein allows for the generation of numerous plots that illustrate the flow and pressure distributions, somewhat similar to the plots illustrated in FIG. 9A and 9B, for different parameters and configurations, such as the relative rotation rates, type of fluid, fluid flow rate, fluid outlet locations, and/or groove depths.

The numerous plots are capable of predicting the distribution of fluid flow between the polishing pad and the substrate, including the effects of a grooved pad.

Fluid Composition

Referring back to FIG. 4, additionally, in one embodiment, the present invention tracks and/or estimates the composition of the fluid 60 at various locations in the gap 64. The fluid composition "FC" is also sometimes referred to as the freshness of the fluid 60 or the fluid freshness factor. As provided herein, it is believed that the fluid 60 that first enters the gap 64 through the fluid outlet(s) has a different composition than the fluid 60 that is exiting the gap 64. Further, the fluid composition of the fluid 60 in the gap 64 will vary accordingly to the distance traveled in the gap 64 and/or the time spent in the gap 64.

For example, fresh fluid 60 that enters the gap 64 at the fluid outlet(s) contains many abrasive particles and is therefore very effective at promoting polishing. As the fluid 60 flows in the gap 64, abrasive particles are captured by the asperities in the pad 48. Thus, the asperities on the pad 48 act somewhat like a filter that captures some of the abrasive particles from the fluid 60. Stated another way, as the fluid 60 flows through the gap 64, it becomes depleted of abrasive particles. As provided herein, fluid 60 which has been in the gap 64 for a long time and/or travels a long distance contains relatively few abrasive particles.

Further, the chemical composition of the liquid of the fluid 60 may also change depending on the distance traveled in the gap 64 and/or the length of time in the gap 64. More specifically, chemical interactions between the liquid of the fluid 60 and substrate 12 can alter the viscosity, pH and/or density of the fluid 60.

It is also believed that the effectiveness of each element of the pad 48 at polishing the substrate 12 at any given time is dependant upon the average composition of the fluid 60 in the gap 64 at that element at that time. Stated another way, the fresher the average fluid 60 at the element at a given time, the more effective that element will be at polishing. Further, the composition of the fluid experienced by an element is a dynamic situation.

In one embodiment, the fluid composition is calculated by tracking characteristic particles in the fluid 60 emitted from each fluid outlet at each time step. For example, several particles can be emitted from various positions in each fluid outlet at each time step. At each time step, the position of each characteristic particle is advanced with the local fluid velocity. The average fluid composition of the fluid passing each point on the pad 48 is calculated at each time step.

The rate of decay to the fluid effectiveness will vary according a number of factors, including the type of fluid 60 utilized, the type of substrate 12 and the type of pad 48. One way to calibrate the decay rate of the fluid effectiveness can be accomplished by detailed experimentation. In one embodiment, the fluid effectiveness is set to decay to zero over a fixed travel time in the gap. In another embodiment, the fluid effectiveness is set to decay to zero over a fixed travel distance in the gap. As an example, fluid effectiveness can range from 1 to 0 or some other range.

In one embodiment, the control system can evaluate the fluid composition at some or all the elements 500 at one or more of the time steps. In another embodiment, at each time step, the control system evaluates the average composition of the fluid for each element. The information regarding fluid composition may be useful for a number of things, including, a better estimate of the material removal rate, better designs for the location of the fluid outlets, better control over the appropriate flow rate delivered by the fluid source 32 to the gap 64. This may be used to determine which areas on the pad are most effective at polishing, and also to determine the distribution of the polishing rate under the pad.

Figure 10A:
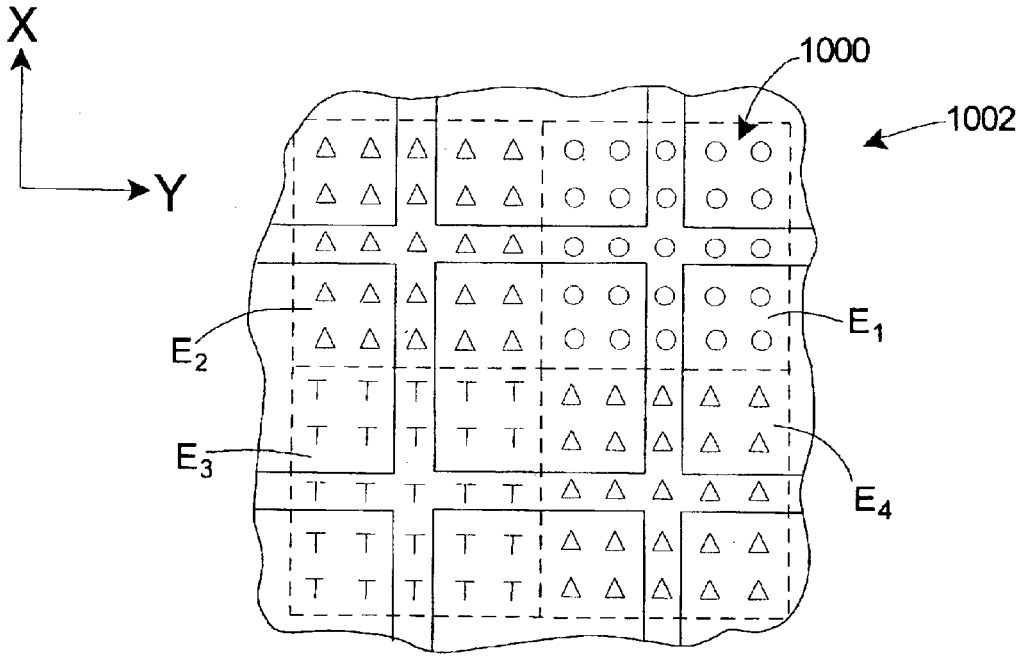
FIG. 10A is a first illustration of a portion of a flow region and fluid composition data.

FIG. 10A illustrates a portion of a flow region 1002 that is divided into a plurality of elements 1000 (illustrated with dashed lines), including $E_1$, $E_2$, $E_3$, and $E_4$ at time step $T_1$. The flow region 1002 represents the area for fluid flow in a gap between a grooved pad and a substrate.

In one embodiment, the rate of decay of the fluid composition is related to the distance traveled in the gap. For example, for a given fluid 60, it is experimentally determined that (i) for a distance $D_1$ traveled in the gap 64, the fluid 60 has a fluid composition of $FC_1$ (represented as circles), (ii) for a distance $D_2$ traveled in the gap 64, the fluid 60 has a fluid composition of $FC_2$ (represented as squares), (iii) for a distance $D_3$ traveled in the gap 64, the fluid 60 has a fluid composition of $FC_3$ (represented as triangles), (iv) for a distance $D_4$ traveled in the gap 64, the fluid 60 has a fluid composition of $FC_4$ (represented as X's), and (v) for a distance $D_5$ traveled in the gap 64, the fluid 60 has a fluid composition of $FC_5$ (represented as T's). In this example, the fluid composition is freshest at $FC_1$ and decreases incrementally from $FC_1$ to $FC_5$.

Utilizing the flow determinations, it is possible to determine the average fluid composition at a particular element 1000 at a particular time. As an example, at time step $T_1$—at element $E_1$, it is determined utilizing the fluid flow calculations that the average fluid has traveled a distance $D_1$ in the gap 64. Thus at $T_1$, $E_1$, the fluid composition is $FC_1$. Somewhat similarly, at time step $T_1$—at element $E_2$, it is determined utilizing the fluid flow calculations that the fluid 60 has traveled a distance $D_3$ in the gap 64. Thus at $T_1$, $E_2$, the fluid composition is $FC_3$. Further, at time step $T_1$—at element $E_3$, it is determined utilizing the fluid flow calculations that the fluid 60 has traveled a distance $D_5$ in the gap 64. Thus at $T_1$, $E_3$, the fluid composition is $FC_5$. Moreover, at time step $T_1$—at element $E_4$, it is determined utilizing the fluid flow calculations that the fluid 60 has traveled a distance $D_3$ in the gap 64. Thus at $T_1$, $E_4$, the fluid composition is $FC_3$.

In this example, at $T_1$, the fluid composition at $E_2$ is approximately equal to the fluid composition at $E_4$. Further, the fluid is freshest at $E_1$ and least fresh at $E_3$.

Subsequently, for example, at time step $T_2$—at element $E_1$, it is determined utilizing the fluid flow calculations that the average fluid has traveled a distance $D_2$ in the gap 64. Thus at $T_2$, $E_1$, the fluid composition is $FC_2$. Somewhat similarly, at time step $T_2$—at element $E_2$, it is determined utilizing the fluid flow calculations that the fluid 60 has traveled a distance $D_1$ in the gap 64. Thus at $T_2$, $E_2$, the fluid composition is $FC_1$. Further, at time step $T_2$—at element $E_3$, it is determined utilizing the fluid flow calculations that the fluid 60 has traveled a distance $D_4$ in the gap 64. Thus at $T_2$, $E_3$, the fluid composition is $FC_4$. Moreover, at time step $T_2$—at element $E_4$, it is determined utilizing the fluid flow calculations that the fluid 60 has traveled a distance $D_4$ in the gap 64. In this example, at $T_2$, the fluid is freshest at $E_2$.

It should be noted that this procedure can be repeated for each of the elements and for each of the time steps.

Alternatively, for example, the rate of decay of the fluid composition can be related to the time in the gap. In this embodiment, for example, for a given fluid, it is experimentally determined that (i) for a gap time $GT_1$ in the gap 64, the fluid 60 has a fluid composition of $FC_1$, (ii) for a gap time $GT_2$ in the gap 64, the fluid 60 has a fluid composition of $FC_2$, (iii) for a gap time $GT_3$ in the gap 64, the fluid 60 has a fluid composition of $FC_3$, (iv) for a gap time $GT_4$ in the gap 64, the fluid 60 has a fluid composition of $FC_4$, (v) for a gap time $GT_5$ in the gap 64, the fluid 60 has a fluid composition of $FC_5$. In this example, the fluid composition is again freshest at $FC_1$ and decreases incrementally from $FC_1$ to $FC_5$.

Figure 10B:
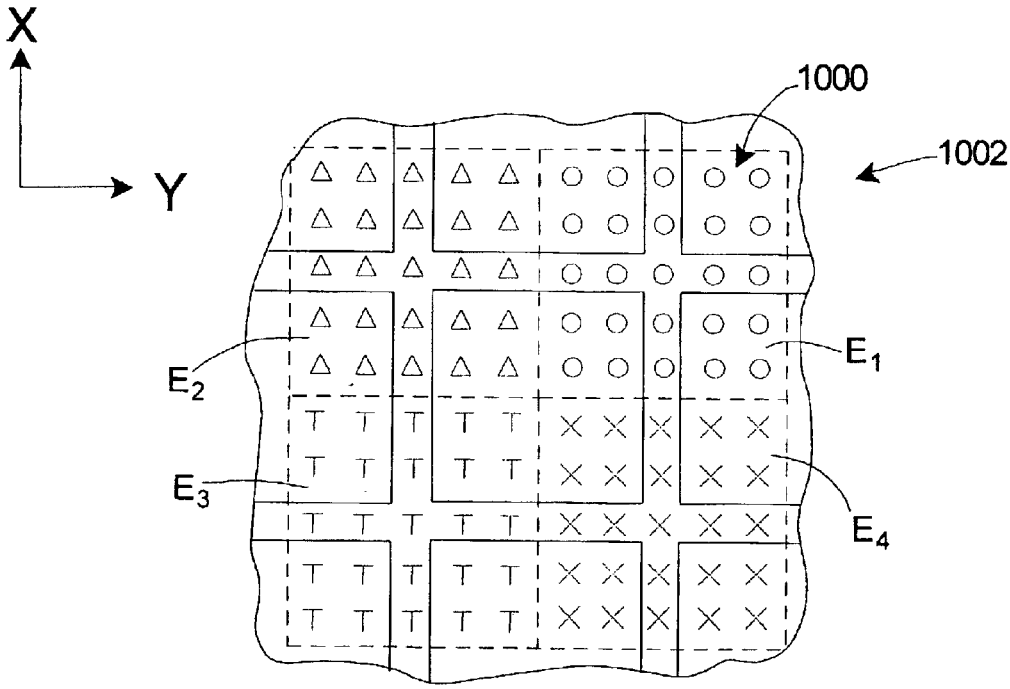
FIG. 10B is a second illustration of a portion of a flow region and fluid composition data.

Utilizing the flow determinations, it is also possible to determine the average fluid composition at a particular element at a particular time based upon the amount of gap time GT of the fluid in the gap. FIG. 10B illustrates the flow region 1002, the elements 1000 and the fluid composition at time step $T_1$. As an example, at time step $T_1$—at element $E_1$, it is determined utilizing the fluid flow calculations that the average fluid 60 has a gap time $GT_1$ in the gap 64. Thus at $T_1$, $E_1$, the fluid composition is $FC_1$. Somewhat similarly, at time step $T_1$—at element $E_2$, it is determined utilizing the fluid flow calculations that the average fluid 60 has a gap time $GT_3$ in the gap 64. Thus at $T_1$, $E_2$, the fluid composition is $FC_3$. Further, at time step $T_1$—at element $E_3$, it is determined utilizing the fluid flow calculations that the fluid 60 has a gap time $GT_5$ in the gap 64. Thus at $T_1$, $E_3$, the fluid composition is $FC_5$. Moreover, at time step $T_1$—at element $E_4$, it is determined utilizing the fluid flow calculations that the fluid 60 has a gap time $GT_4$ in the gap 64. Thus at $T_1$, $E_4$, the fluid composition is $FC_4$.

In this example, at $T_1$, the fluid is freshest at $E_1$ and least fresh at $E_3$. This procedure can also be repeated for each of the elements and for each of the time steps.

The evaluation of the fluid freshness can be used to select better locations of fluid outlets. Fluid outlet(s) should be placed to get the most uniform distribution of fresh fluid 60 in the gap 64. Also, to avoid wasting fluid 60 the flow should be designed so that fresh fluid 60 does not pass out of the gap 64 too quickly, before it can be used effectively. The freshness factor calculation can also be used to refine estimates of the polishing rate distribution.

Polishing Rate Model

Additionally, a material removal rate model that attempts to account for the effects of the fluid flow in the gap 64 at each element, fluid pressure in the gap 64 at each element, relative velocity at each element, and the composition of the fluid 60 in the gap 64 at each element is provided as follows:

$$mrr=K(P_L-P_F)U_{rel}(FC) \qquad \text{Equation 7}$$

In this equation, mrr is the material removal rate; K is an unknown constant that will vary according to the pad material, substrate type and fluid type and is determined by experimental testing; $P_L$ is pressure applied by the pad; $P_F$ is the hydrostatic lift under the pad calculated by the fluid flow simulations provided above; $U_{rel}$ is the pad/substrate relative velocity; and FC reflects the fluid composition of the fluid under a given element of the pad. Eqn. 7 can be solved for each of the elements and for each of the time steps to accurately estimate material removal rate.

This polishing rate model is based somewhat on a modified form of Preston's Law (Preston, 1927) in which the polishing rate is proportional to the product of the load pressure and the pad/substrate relative velocity. In this embodiment, the load pressure is reduced by the hydrostatic lift. This feature allows for the correct prediction in the reduction in polishing rate with shallow grooves. Also, the polishing rate model utilizes the multiplicative fluid composition factor.

To calculate the polishing rate at a given radius on the substrate, the present invention accounts for the fraction of the substrate that is under the pad, the average relative velocity at that substrate radius, the average load at that radius, and the average fluid freshness factor. In one embodiment, the average material removal rate at a given substrate radius is determined by the average material removal rate of all elements at the radius and the fraction of that radius covered by the other substrate.

It should be noted that the polishing rate model provided above is only one example of how the calculated values of the relative velocity, fluid flow, hydrostatic pressure and fluid composition can be utilized in a polishing rate model. As provided herein, one or more of the calculated values of relative velocity, fluid flow, hydrostatic pressure and/or fluid composition can be used in another type of formula to calculate and/or estimate the polishing rate of an apparatus.

In one embodiment, the control system uses the fluid flow simulation algorithm to determine the fluid pressure distribution under the pad. This information is needed to tell how the pad is lifted by the fluid pressure. This information is needed to determine the polishing rate distribution.

In one embodiment of the present invention, the control system 24 (illustrated in FIG. 1) can be used to calculate one or more of (i) the relative velocity between the pad 48 and the substrate 12 at multiple locations; (ii) the fluid flow in the gap at multiple locations; (iii) pressure distributions and the hydrostatic pressure in the gap at multiple locations; (iv) a fluid freshness at multiple locations in the gap; and/or (v) the material removal rate of the apparatus 10 at multiple locations. Additionally, one or more of these things can be calculated for one or more of the time steps.

Alternatively, one or more of the calculations of (i) the relative velocity between the pad 48 and the substrate 12 at multiple locations; (ii) the fluid flow in the gap at multiple locations; (iii) pressure distributions and the hydrostatic pressure in the gap at multiple locations; (iv) a fluid freshness at multiple locations in the gap; and/or (v) the material removal rate of the apparatus 10 can be performed by a separate computer system. In this embodiment, for example, the results of the calculations can be used and/or programmed into the control system 24 of the apparatus 10. With this information, the control system 24 can adjust one or more functions of the apparatus 10. For example, with this information (i) the rotation rate of the pad, (ii) the lateral movement of the pad, (iii) the rotation rate of the substrate, (iv) the type of fluid, (v) the pressure of the fluid, and/or (vi) the groove shape of the pad can be adjusted to improve accuracy and efficiency of the apparatus 10.

While the particular apparatus 10 and method as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A method for estimating the flow of a fluid in a gap between a first substrate and a second substrate, the method comprising the steps of:

dividing the gap into a plurality of elements;

determining a relative velocity between the first substrate and the second substrate at one element;

determining a pressure gradient of the fluid in the gap at one element;

determining a height of the gap between the first substrate and the second substrate; and utilizing the relative velocity, the pressure gradient and the height of the gap in a hybrid Navier-Stokes/lubrication theory formulation to estimate the flow of fluid at one element.

2. The method of claim 1 wherein the step of utilizing includes utilizing the hybrid Navier-Stokes/lubrication theory formulation to calculate the flow of fluid at each of the elements.

3. The method of claim 2 wherein the step of determining a relative velocity includes determining relative velocity at each of the elements.

4. The method of claim 2 wherein the step of determining a pressure gradient includes determining a pressure gradient at each of the elements.

5. The method of claim 1 wherein the lubrication theory portion of the formulation is as follows:

$$\frac{1}{2}U_{rel}\left[(h+d)\cdot w\cdot g\left(\frac{d}{w}\right)+h\cdot(L-w)\right]-\frac{p_{i+1}-p_i}{\mu\cdot L}\left[\frac{w^3d^3}{8(w+d)^2}+\frac{Lh^3}{12}+\frac{wh^3}{6}\right]$$

where $U_{rel}$ is the relative velocity of the substrates at a first element; h is the first substrate flight height; d is the depth of the gap; w is the width of the gap; g is an empirical function of a groove aspect ratio; L is the length of the first element; $P_{i+1}$ is the pressure at a second element; $P_i$ is the pressure in the first element; and $\mu$ is a viscosity of the fluid.

6. The method of claim 1 wherein the hybrid Navier-Stokes/lubrication theory formulation is as follows:

$$Q\approx ff(U_{rel},\theta)\frac{1}{2}U_{rel}\left[(h+d)\cdot w\cdot g\left(\frac{d}{w}\right)+h\cdot(L-w)\right]-\frac{p_{i+1}-p_i}{\mu\cdot L}\left[\frac{w^3d^3}{8(w+d)^2}+\frac{Lh^3}{12}+\frac{wh^3}{6}\right]$$

where Q is the fluid flow from a first element to second element; ff is a flow fraction function; $U_{rel}$ is the relative velocity of the substrates at the first element; h is the first substrate flight height; d is the depth of the gap; w is the width of the gap; g is an empirical function of a groove aspect ratio; L is the length of the first element; $P_{i+1}$ is the pressure at the second element; $P_i$ is a pressure at the first element; $\mu$ is a viscosity of the fluid; and θ is the angle of the relative velocity.

7. The method of claim 1 wherein the Navier-Stokes portion of the hybrid Navier-Stokes/lubrication theory formulation is a function that is determined by detailed Navier-Stokes analysis of a portion of the gap.

8. The method of claim 7 wherein the function is a flow fraction that compensates for the fraction of flow affected by relative velocities of the substrates.

9. A method for evaluating a material removal rate of the first substrate utilizing the flow of fluid calculated by the method of claim 1.

10. The method of claim 9 the step of monitoring a fluid composition of the fluid in the gap at one of the elements.

11. A method for evaluating a material removal rate including the step of utilizing the formula:

$$mrr=K(P_L-P_F)U_{rel}(FC)$$

where, mrr is the material removal rate; K is an unknown constant; $P_L$ is pressure applied by the first substrate; $P_F$ is a hydrostatic lift between the substrates determined during flow calculations by the method of claim 1; $U_{rel}$ is the relative velocity of the substrates; and FC is a fluid composition of the fluid in the gap.

12. A method for evaluating a rate of polishing by a pad on a substrate, the pad being spaced apart a gap from the substrate that is filled with a fluid, the method comprising the steps of:

dividing the gap into a plurality of elements;

determining the pressure applied by the pad to the substrate at one of the elements;

determining the relative velocity between the pad and the substrate at one of the elements; and estimating a composition of the fluid at one of the elements.

13. The method of claim 12 wherein the step of estimating includes estimating the composition of the fluid at each of the elements.

14. The method of claim 12 wherein the composition is estimated at a plurality of separate time steps at each of the elements.

15. The method of claim 12 wherein the step of estimating includes estimating a distance that the fluid travels in the gap.

16. The method of claim 12 wherein the step of estimating includes estimating a time that the fluid is in the gap.

17. The method of claim 12 further comprising the step of estimating the flow of the fluid in the gap utilizing a hybrid Navier-Stokes/lubrication theory formulation to calculate the flow of fluid in at least a portion of the gap.

18. A method for estimating the flow of a fluid in a gap between a first substrate and a second substrate, the method comprising the steps of:

dividing the gap into a plurality of elements; and utilizing a hybrid Navier-Stokes/lubrication theory formulation to calculate the flow of fluid at one of the elements.

19. The method of claim 18 wherein the step of utilizing includes utilizing the hybrid Navier-Stokes/lubrication theory formulation to calculate the flow of fluid at each of the elements.

20. The method of claim 19 wherein the step of dividing the gap includes dividing the gap into at least approximately 200 elements.

21. The method of claim 19 wherein the fluid flow is calculated at a plurality of time steps at each of the elements.

22. The method of claim 18 herein the first substrate is a grooved pad and the second substrate is a wafer.

23. The method of claim 18 wherein the Navier-Stokes portion of the hybrid Navier-Stokes/lubrication theory formulation is a function that is determined by detailed Navier-Stokes analysis of a portion of the gap.

24. A method for evaluating a material removal rate of the first substrate utilizing the flow of fluid calculated by the method of claim 18.

25. The method of claim 24 further comprising the step of utilizing a pressure of the fluid in at least a portion of the gap to evaluate the material removal rate.

26. The method of claim 18 wherein the fluid flow is calculated for a plurality of time steps.

27. A method for polishing a second substrate, the method comprising the steps of providing a polishing apparatus that (i) positions a first substrate adjacent to the second substrate, (ii) directs a fluid into a gap between the substrates, and (iii) controls a function of the apparatus based upon the fluid flow calculated by the method of claim 18.

28. The method of claim 27 wherein the function is a rotation rate of one or both of the substrates.

29. The method of claim 27 wherein the function is a flow rate of the fluid into the gap.

30. The method of claim 27 wherein the function is a rate of movement of the first substrate laterally relative to the second substrate.

31. A second substrate polished by the method of claim 27.

32. An apparatus that estimates fluid flow in a gap between a first substrate and a second substrate utilizing the hybrid Navier-Stokes/lubrication theory formulation as provided in claim 18.

33. A method for estimating the flow of a fluid in a gap between a first substrate and a second substrate, the method comprising the steps of:

dividing the gap into a plurality of elements;

calculating a relative velocity of the substrates at each of the elements; and utilizing a hybrid Navier-Stokes/lubrication theory formulation to estimate the flow of fluid in at least a portion of the gap.

34. A method for estimating the flow of a fluid in a gap between a first substrate and a second substrate, the method comprising the steps of:

dividing the gap into a plurality of elements;

calculating a pressure at each of the elements; and utilizing a hybrid Navier-Stokes/lubrication theory formulation to estimate the flow of fluid in at least a portion of the gap.

35. A method for estimating the flow of a fluid in a gap between a first substrate and a second substrate, the method comprising the step of:

utilizing a hybrid Navier-Stokes/lubrication theory formulation to estimate the flow of fluid in at least a portion of the gap, wherein the lubrication theory portion of the formulation is as follows:

$$\frac{1}{2}U_{rel}\left[(h+d)\cdot w\cdot g\left(\frac{d}{w}\right)+h\cdot(L-w)\right]-\frac{p_{i+1}-p_i}{\mu\cdot L}\left[\frac{w^3d^3}{8(w+d)^2}+\frac{Lh^3}{12}+\frac{wh^3}{6}\right]$$

where $U_{rel}$ is the relative velocity of the substrates at a first element; h is the first substrate flight height; d is the depth of the gap; w is the width of the gap; g is an empirical function of a groove aspect ratio; L is the length of the first element; $P_{i+1}$ is the pressure at a second element; $P_i$ is the pressure in the first element; and $\mu$ is a viscosity of the fluid.

36. A method for estimating the flow of a fluid in a gap between a first substrate and a second substrate, the method comprising the step of:

utilizing a hybrid Navier-Stokes/lubrication theory formulation to estimate the flow of fluid in at least a portion of the gap, wherein the hybrid Navier-Stokes/lubrication theory formulation is as follows:

$$Q\approx ff(U_{rel},\theta)\frac{1}{2}U_{rel}\left[(h+d)\cdot w\cdot g\left(\frac{d}{w}\right)+h\cdot(L-w)\right]-\frac{p_{i+1}-p_i}{\mu\cdot L}\left[\frac{w^3d^3}{8(w+d)^2}+\frac{Lh^3}{12}+\frac{wh^3}{6}\right]$$

where Q is the fluid flow from a first element to second element; ff is a flow fraction function; $U_{rel}$ is the relative velocity of the substrates at the first element; h is the first substrate flight height; d is the depth of the gap; w is the width of the gap; g is an empirical function of a groove aspect ratio; L is the length of the first element; $P_{i+1}$ is the pressure at the second element; $P_i$ is a pressure at the first element; $\mu$ is a viscosity of the fluid; and $\theta$ is the angle of the relative velocity.

37. A method for estimating the flow of a fluid in a gap between a first substrate and a second substrate, the method comprising the step of:

utilizing a hybrid Navier-Stokes/lubrication theory formulation to estimate the flow of fluid in at least a portion of the gap, wherein the Navier-Stokes portion of the hybrid Navier-Stokes/lubrication theory formulation is a function that is determined by detailed Navier-Stokes analysis of a portion of the gap, and wherein the function is a flow fraction that compensates for the fraction of flow affected by relative velocities of the substrates.

38. A method for estimating the flow of a fluid in a gap between a first substrate and a second substrate, the method comprising the step of:

utilizing a hybrid Navier-Stokes/lubrication theory formulation to estimate the flow of fluid in at least a portion of the gap, wherein the Navier-Stokes portion of the hybrid Navier-Stokes/lubrication theory formulation is a function that is determined by detailed Navier-Stokes analysis of a portion of the gap, and wherein the function is a flow fraction that compensates for the fraction of flow disrupted by pressure gradients.

39. A method for evaluating a material removal rate of a first substrate comprising the steps of:

estimating the flow of a fluid in at least a portion of a gap between the first substrate and a second substrate utilizing a hybrid Navier-Stokes/lubrication theory formulation, wherein the gap is divided into a plurality of elements; and monitoring a fluid composition of the fluid in the gap by estimating the fluid composition of the fluid in the gap at one of the elements.

40. The method of claim 39 wherein the step of monitoring includes estimating the fluid composition of the fluid in the gap at each of the elements.

41. A method for evaluating a material removal rate including the step of utilizing the formula:

$$mrr=K(P_L-P_F)U_{rel}(FC)$$

where, mrr is the material removal rate; K is an unknown constant; $P_L$ is pressure applied by a first substrate; $P_F$ is a hydrostatic lift between the first substrate and a second substrate determined during flow calculations by utilizing a hybrid Navier-Stokes/lubrication theory formulation to estimate the flow of fluid in at least a portion of a gap between the substrates; $U_{rel}$ is the relative velocity of the substrates; and FC is a fluid composition of the fluid in the gap.

42. The method of claim 41 wherein the average material removal rate at a given radius of the second substrate is determined by the average material removal rate of all elements at that radius and the fraction of that radius covered by the first substrate.

43. A method for evaluating a rate of polishing by a pad on a substrate, the method comprising the steps of:

dividing a gap between the pad and the substrate into a plurality of elements; and estimating the composition of a fluid in the gap at one of the elements.

44. The method of claim 43 wherein the step of estimating includes the step of estimating the composition of the fluid in the gap at each of the elements.

45. The method of claim 44 the composition is estimated at a plurality of separate time steps at each of the elements.

46. The method of claim 43 wherein the composition is estimated at a plurality of separate time steps.

47. The method of claim 43 wherein the step of estimating includes estimating a distance that the fluid travels in the gap.

48. The method of claim 43 wherein the step of estimating includes estimating a time that the fluid is in the gap.

49. The method of claim 43 further comprising the step of estimating the flow of the fluid in the gap.

50. The method of claim 49 wherein the step of estimating the flow includes utilizing a hybrid Navier-Stokes/lubrication theory formulation to calculate the flow of fluid in at least a portion of the gap.

51. A method for polishing a substrate, the method comprising the steps of providing a polishing apparatus that (i) positions a pad adjacent to the substrate, (ii) directs a fluid into a gap between the pad and the substrate, and (iii) controls a function of the apparatus based upon the evaluation of the rate of polishing by the method of claim 43.

52. The method of claim 51 wherein the function is the rotation rate of at least one of the pad and the substrate.

53. The method of claim 51 wherein the function is a flow rate of the fluid in the gap.

54. The method of claim 51 wherein the function is a rate of movement of the pad laterally.

55. A substrate polished by the method of claim 51.

56. The method of claim 43 wherein the step of estimating includes the step of tracking the fluid flow in the gap.

57. An apparatus that evaluates a rate of polishing by a pad on a substrate by estimating the composition of a fluid in at least a portion of a gap between the pad and the substrate as provided in claim 43.

58. A method for evaluating a rate of polishing by a pad on a substrate, the method comprising the steps of:

dividing a gap between the pad and the substrate into a plurality of elements;

estimating the composition of a fluid in at least a portion of the gap between the pad and the substrate; and estimating the flow of the fluid in the gap by utilizing a hybrid Navier-Stokes/lubrication theory formulation to calculate the flow of fluid at one of the elements.

59. The method of claim 58 wherein the step of estimating the flow includes the step of estimating the flow of the fluid in the gap by utilizing a hybrid Navier-Stokes/lubrication theory formulation to calculate the flow of fluid at each of the elements.

60. A method for evaluating a rate of polishing by a pad on a substrate, the method comprising the steps of:

dividing a gap between the pad and the substrate into a plurality of elements;

calculating a relative velocity of the pad and the substrate at each of the elements; and estimating the composition of a fluid in at least a portion of the gap between the pad and the substrate.

61. A method for evaluating a rate of polishing by a pad on a substrate, the method comprising the steps of:

dividing a gap between the pad and the substrate into a plurality of elements;

estimating the composition of a fluid in at least a portion of the gap between the pad and the substrate; and calculating a pressure of the fluid in the gap at each of the elements.

62. A method for evaluating a rate of polishing by a pad on a substrate, the method comprising the steps of:

estimating the composition of a fluid in at least a portion of a gap between the pad and the substrate; and utilizing the following formula to evaluate the rate of polishing:

$$mrr=K(P_L-P_F)U_{rel}(FC)$$

where, mrr is the material removal rate; K is an unknown constant; $P_L$ is pressure applied by the pad; $P_F$ is a hydrostatic lift between the pad and the substrate under the pad; $U_{rel}$ is the pad/substrate relative velocity; and FC is the fluid composition of the fluid in the gap.

63. The method of claim 62 further comprising the steps of dividing the gap into a plurality of elements and calculating an mrr for each of the elements.

64. The method of claim 62 further comprising the step of averaging the mrr over elements at a similar radius on the substrate.

* * * * *

UNITED STATES PATENT AND TRADEMARK OFFICE

CERTIFICATE OF CORRECTION

PATENT NO. : 6,947,862 B2
DATED : September 20, 2005
INVENTOR(S) : Eaton et al.

It is certified that error appears in the above-identified patent and that said Letters Patent is hereby corrected as shown below:

Column 19,
Line 26, delete “herein” and substitute -- wherein --.

Column 21,
Line 48, between “44” and “the”, insert -- wherein --.

Signed and Sealed this

Seventh Day of February, 2006

JON W. DUDAS
*Director of the United States Patent and Trademark Office*